US011501698B2

(12) United States Patent
Cho et al.

(10) Patent No.: US 11,501,698 B2
(45) Date of Patent: Nov. 15, 2022

(54) PIXEL AND DISPLAY DEVICE INCLUDING AN EMISSION UNIT OPERATING IN DIFFERENT MODES

(71) Applicant: Samsung Display Co., Ltd., Yongin-si (KR)

(72) Inventors: Eui Myeong Cho, Yongin-si (KR); Ho Cheol Kang, Yongin-si (KR); Seok Young Yoon, Yongin-si (KR); Dae Gwang Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/444,165

(22) Filed: Jul. 30, 2021

(65) Prior Publication Data

US 2022/0122524 A1 Apr. 21, 2022

(30) Foreign Application Priority Data

Oct. 20, 2020 (KR) ..... 10-2020-0136268

(51) Int. Cl.
*G09G 3/32* (2016.01)

(52) U.S. Cl.
CPC ..... *G09G 3/32* (2013.01); *G09G 2300/0426* (2013.01); *G09G 2300/0804* (2013.01);
(Continued)

(58) Field of Classification Search
CPC ..... G09G 3/2007; G09G 3/2018–2025; G09G 3/204; G09G 3/2074; G09G 3/32–3291;
(Continued)

(56) References Cited

U.S. PATENT DOCUMENTS 8,507,923 B2 8/2013 Kim et al.
9,196,197 B2 11/2015 Kim
(Continued)

FOREIGN PATENT DOCUMENTS

JP 2009-111339 A 5/2009
KR 10-2015-0049121 A 5/2015
(Continued)

OTHER PUBLICATIONS

International Search Report dated Nov. 29, 2021 for corresponding Korean PCT Application No. PCT/KR2021/011392 (4 pages).

*Primary Examiner* — Nathan Danielsen
(74) *Attorney, Agent, or Firm* — Lewis Roca Rothgerber Christie LLP

(57) ABSTRACT

A display device includes a pixel. The pixel includes an emission unit and a pixel circuit. The pixel circuit to provide a first driving current to the emission unit in a first current flowing direction in a first mode, and to provide a second driving current to the emission unit in a second current flowing direction different from the first current flowing direction in a second mode. The emission unit includes a first electrode and a second electrode spaced from each other, a first light emitting element connected between the first electrode and the second electrode in the first current flowing direction, and a second light emitting element connected between the first electrode and the second electrode in the second current flowing direction.

19 Claims, 22 Drawing Sheets

(52) U.S. Cl.
CPC ..... *G09G 2300/0842* (2013.01); *G09G 2310/0256* (2013.01); *G09G 2310/0262* (2013.01); *G09G 2310/0278* (2013.01); *G09G 2320/0233* (2013.01)

(58) Field of Classification Search
CPC ... G09G 2300/0421; G09G 2300/0426; G09G 2300/0452; G09G 2300/0804; G09G 2300/0809; G09G 2300/0842; G09G 2300/0861; G09G 2300/088–0895; G09G 2310/0202; G09G 2310/0213; G09G 2310/0243; G09G 2310/0254; G09G 2310/0256; G09G 2310/0262; G09G 2310/0264; G09G 2310/0278; G09G 2310/0289; G09G 2310/06; G09G 2310/067; G09G 2310/08; G09G 2320/0233; G09G 2320/0242; G09G 2320/043; G09G 2320/045; G09G 2320/0686; G09G 2330/028
See application file for complete search history.

(56) References Cited

U.S. PATENT DOCUMENTS

| | | | | |
|---|---|---|---|---|
| 10,658,605 | B2 | 5/2020 | Lee et al. | |
| 10,964,253 | B2 | 3/2021 | Lim et al. | |
| 11,037,499 | B2 | 6/2021 | Kim et al. | |
| 2018/0025690 | A1* | 1/2018 | Bao | G09G 3/3225 345/691 |
| 2019/0156733 | A1* | 5/2019 | Park | G09G 3/32 |
| 2020/0111410 | A1* | 4/2020 | Lim | G09G 3/32 |
| 2020/0219435 | A1* | 7/2020 | Chen | G09G 3/32 |
| 2021/0035492 | A1 | 2/2021 | Lee | |
| 2021/0319736 | A1 | 10/2021 | Park et al. | |

FOREIGN PATENT DOCUMENTS

| | | | |
|---|---|---|---|
| KR | 10-2019-0029831 | A | 3/2019 |
| KR | 10-2019-0048934 | A | 5/2019 |
| KR | 10-2020-0005687 | A | 1/2020 |
| KR | 10-2020-0039900 | A | 4/2020 |
| KR | 10-2021-0016211 | A | 2/2021 |
| KR | 10-2021-0126826 | A | 10/2021 |

* cited by examiner

PIXEL AND DISPLAY DEVICE INCLUDING AN EMISSION UNIT OPERATING IN DIFFERENT MODES

CROSS-REFERENCE TO RELATED APPLICATION

This application claims priority to and the benefit of Korean Patent Application No. 10-2020-0136268 filed in the Korean Intellectual Property Office on Oct. 20, 2020, the entire content of which is incorporated herein by reference.

BACKGROUND

1. Field

The present disclosure relates to a pixel and a display device including the same.

2. Description of the Related Art

With increasing interest in information display and increasing demand for use of portable information media, the requirements and commercialization for display devices are intensively increasing.

SUMMARY

An aspect of the embodiments of the present disclosure is to provide a pixel capable of improving luminance deviation and/or variation and a display device including the same.

Another aspect of the embodiments of the present disclosure is to provide a display device capable of improving lifespan.

In order to achieve features and aspects of the embodiments of the present disclosure, a pixel according to embodiments of the present disclosure includes: an emission unit connected between a first power line and a second power line; and a pixel circuit to provide a first driving current to the emission unit in a first current flowing direction in a first mode, and to provide a second driving current to the emission unit in a second current flowing direction different from the first current flowing direction in a second mode, wherein the emission unit includes: a first electrode and a second electrode spaced from each other; a first light emitting element connected between the first electrode and the second electrode in the first current flowing direction; and a second light emitting element connected between the first electrode and the second electrode in the second current flowing direction.

According to an embodiment, the pixel circuit may include: a first driving transistor connected between the first power line and the first electrode; a first scan transistor connected between a data line and a gate electrode of the first driving transistor, the first scan transistor having a gate electrode connected to a first scan line; and a first storage capacitor connected between the gate electrode of the first driving transistor and the first electrode, wherein the second electrode is connected to the second power line.

According to an embodiment, the pixel circuit may further include a first sensing transistor connected between a readout line and the first electrode, the first sensing transistor having a gate electrode connected to a first sensing line.

According to an embodiment, the pixel circuit may further include: a second driving transistor connected between the first power line and the first electrode; and a second scan transistor connected between the data line and a gate electrode of the second driving transistor, the second scan transistor having a gate electrode connected to a second scan line.

According to an embodiment, the pixel circuit may further include a second storage capacitor connected between the gate electrode of the second driving transistor and one electrode of the second driving transistor.

According to an embodiment, the second storage capacitor may be connected between the gate electrode of the second driving transistor and the first electrode.

According to an embodiment, the second storage capacitor may be connected between the gate electrode of the second driving transistor and the first power line.

According to an embodiment, in the first mode, the first scan transistor and the first sensing transistor may be turned on and the second scan transistor may be turned off, and in the second mode, the second scan transistor and the first sensing transistor may be turned on and the first scan transistor may be turned off.

According to an embodiment, the pixel circuit may be alternately driven in the first mode and the second mode with a first period, and the first period may be greater than or equal to one frame.

According to an embodiment, a voltage level of a first power supply voltage applied to the first power line and a voltage level of a second power supply voltage applied to the second power line may be interchanged with the first period.

According to an embodiment, the pixel may further include: a first power control transistor connected between the first power line and a third power line, the first power control transistor having a gate electrode connected to a control line; and a second power control transistor connected between the first power line and a fourth power line, the second power control transistor having a gate electrode connected to the control line, wherein one of the first power control transistor and the second power control transistor may be an N-type transistor, and other one of the first power control transistor and the second power control transistor may be a P-type transistor.

According to an embodiment, the pixel may further include: a third power control transistor connected between the second power line and the fourth power line, the third power control transistor having a gate electrode connected to the control line; and a fourth power control transistor connected between the second power line and the third power line, the fourth power control transistor having a gate electrode connected to the control line, wherein the third power control transistor may be a transistor of a same type as the first power control transistor, and the fourth power control transistor may be a transistor of a same type as the second power control transistor.

According to an embodiment, a first end portion of the first light emitting element and a second end portion of the second light emitting element may be electrically connected to the first electrode, a second end portion of the first light emitting element and a first end portion of the second light emitting element may be electrically connected to the second electrode, and the first end portion of the first light emitting element and the first end portion of the second light emitting element may correspond to a same type of a semiconductor layer.

According to an embodiment, a total number of the first light emitting elements in the emission unit may be substantially equal to a total number of the second light emitting elements in the emission unit.

According to an embodiment, the emission unit may further include a plurality of light emitting element packages connected between the first electrode and the second electrode, each of the plurality of light emitting element packages may include a first lead electrode, a second lead electrode, and a pair of light emitting elements arranged between the first lead electrode and the second lead electrode in different current flowing directions, and the pair of light emitting elements may include the first light emitting element and the second light emitting element.

According to an embodiment, some of the plurality of light emitting element packages may be mutually connected in series between the first electrode and the second electrode.

In order to achieve features and aspects of the present disclosure, a display device according to some embodiments of the present disclosure includes: pixels; a scan driver for supplying scan signals to the pixels through scan lines and supplying sensing signals to the pixels through sensing lines; and a data driver for supplying data signals to the pixels through data lines and supplying an initialization signal to the pixels through readout lines, wherein each of the pixels includes: an emission unit connected between a first power line and a second power line; and a pixel circuit for providing a first driving current to the emission unit in a first current flowing direction in response to a first scan signal among the scan signals and a first sensing signal among the sensing signals in a first mode, and providing a second driving current to the emission unit in a second current flowing direction different from the first current flowing direction in response to a second scan signal among the scan signals and the first sensing signal in a second mode, and the emission unit includes: a first electrode and a second electrode spaced apart from each other; a first light emitting element connected between the first electrode and the second electrode in the first current flowing direction; and a second light emitting element connected between the first electrode and the second electrode in the second current flowing direction.

According to an embodiment, a total number of the first light emitting element in the emission unit may be substantially equal to a total number of the second light emitting element.

According to an embodiment, the display device may further include a power supply for supplying, to the pixels, a first power supply voltage through the first power line and a second power supply voltage through the second power line, wherein the power supply may interchange a voltage level of the first power supply voltage and a voltage level of the second power supply voltage with a first period.

According to an embodiment, the display device may further include a power supply for supplying the first power supply voltage to a third power line and the second power supply voltage to a fourth power line, wherein each of the pixels may further include: a first power control transistor connected between the first power line and the third power line, the first power control transistor having a gate electrode connected to a control line; and a second power control transistor connected between the first power line and the fourth power line, the second power control transistor having a gate electrode connected to the control line, one of the first power control transistor and the second power control transistor is an N-type transistor, and another of the first power control transistor and the second power control transistor is a P-type transistor.

DETAILED DESCRIPTION

Figure 1A:
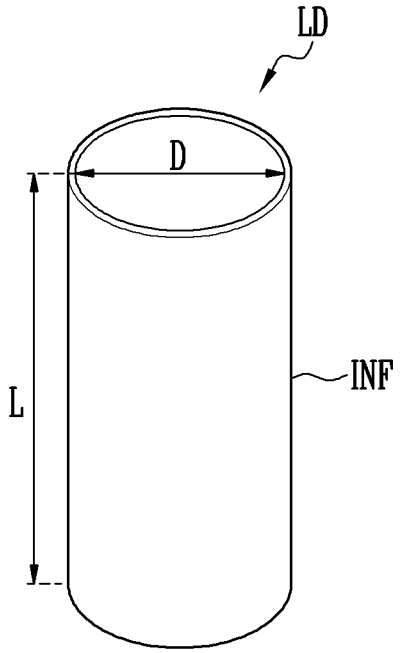
FIG. 1A is a perspective view schematically illustrating a light emitting element according to an embodiment.

Hereinafter, embodiments of the present disclosure will be described in more detail with reference to the accompanying drawings. The same elements in the drawings are denoted by the same reference numerals, and redundant descriptions thereof are omitted.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the scope of the present disclosure.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the present disclosure. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present disclosure refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Figure 1B:
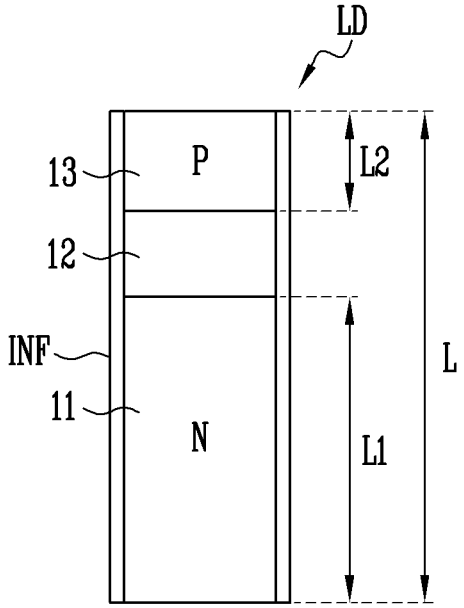
FIG. 1B is a cross-sectional view of the light emitting element of FIG. 1A.

FIG. 1A is a perspective view schematically illustrating a light emitting element according to an embodiment. FIG. 1B is a cross-sectional view of the light emitting element of FIG. 1A. In an embodiment of the present disclosure, the type and/or shape of the light emitting element is not limited to the embodiment illustrated in FIGS. 1A and 1B.

Referring to FIGS. 1A and 1B, a light emitting element LD may include a first semiconductor layer 11, a second semiconductor layer 13, and an active layer 12 disposed between the first and second semiconductor layers 11 and 13. For example, the light emitting element LD may implement a light emitting stack in which the first semiconductor layer 11, the active layer 12, and the second semiconductor layer 13 are sequentially stacked along the length direction or extension of the light emitting element LD.

The light emitting element LD may be provided in a shape extending in one direction. When the extending direction of the light emitting element LD is the longitudinal direction, the light emitting element LD may include one end portion (or lower end portion) and the other end portion (or upper end portion) in the extending direction. One of the first and second semiconductor layers 11 and 13 may be disposed at one end portion (or lower end portion) of the light emitting element LD, and the other one of the first and second semiconductor layers 11 and 13 may be disposed at the other end portion (or upper end portion) of the light emitting element LD. For example, the first semiconductor layer 11 may be disposed at one end portion (or lower end portion) of the light emitting element LD, and the second semiconductor layer 13 may be disposed at the other end portion (or upper end portion) of the light emitting element LD.

The light emitting element LD may be provided in various shapes. For example, the light emitting element LD may have a rod-like shape or a bar-like shape that is long in the longitudinal direction (i.e., the aspect ratio is greater than 1). In an embodiment of the present disclosure, a length L of the light emitting element LD in the longitudinal direction may be greater than a diameter D (or a width of a cross-section) thereof. The light emitting element LD may include, for example, a light emitting diode (LED) manufactured in a very small size to have a diameter D and/or a length L of about a micro scale or a nano scale.

The diameter D of the light emitting element LD may be about 0.5 μm to about 500 μm, and the length L of the light emitting element LD may be about 1 μm to about 10 μm. However, the diameter D and length L of the light emitting element LD are not limited thereto, and the size of the light emitting element LD may be changed to meet the requirements (or design conditions) of a lighting device or a self-luminous display device to which the light emitting element LD is applied.

The first semiconductor layer 11 may include, for example, at least one n-type semiconductor layer. For example, the first semiconductor layer 11 may include one semiconductor material selected from InAlGaN, GaN, AlGaN, InGaN, AlN, and InN, and may be an n-type semiconductor layer doped with a first conductive dopant (or n-type dopant) such as Si, Ge, or Sn. However, the material forming the first semiconductor layer 11 is not limited thereto, and the first semiconductor layer 11 may include various other materials. In an embodiment of the present disclosure, the first semiconductor layer 11 may include a GaN semiconductor material doped with a first conductive dopant (or n-type dopant). The first semiconductor layer 11 may include an upper surface in contact with the active layer 12 and a lower surface exposed to the outside in the direction of the length L of the light emitting element LD. The lower surface of the first semiconductor layer 11 may be one end portion (or lower end portion) of the light emitting element LD.

The active layer 12 may be disposed on the first semiconductor layer 11 and may be formed in a single or multiple quantum well structure. For example, when the active layer 12 is formed in a multiple quantum well structure, the active layer 12 may include a barrier layer, a strain reinforcing layer, and a well layer that are periodically repeatedly stacked as one unit. Because the strain reinforcing layer has a smaller lattice constant than the barrier layer, the strain applied to the well layer, for example, the compression strain may be further reinforced. However, the structure of the active layer 12 is not limited to the above-described embodiment.

The active layer 12 may emit light having a wavelength of 400 nm to 900 nm, and may use a double hetero structure. In an embodiment of the present disclosure, a clad layer doped with a conductive dopant may be formed above and/or below the active layer 12 in the direction of the length L of the light emitting element LD. For example, the clad layer may include an AlGaN layer or an InAlGaN layer. According to an embodiment, a material such as AlGaN or InAlGaN may be used to form the active layer 12, and various other materials may be used to form the active layer 12. The active layer 12 may include a first surface in contact with the first semiconductor layer 11 and a second surface in contact with the second semiconductor layer 13.

When an electric field of a suitable voltage (e.g., a set or predetermined voltage) or higher is applied between both end portions of the light emitting element LD, electron-hole pairs recombine in the active layer 12 to cause the light emitting element LD to emit light. By controlling the light emission of the light emitting element LD using this principle, the light emitting element LD may be used as light sources (or light emitting sources) for various light emitting devices including pixels of a display device.

The second semiconductor layer 13 may be disposed on the second surface of the active layer 12 and may include a semiconductor layer of a different type from the first semiconductor layer 11. As an example, the second semiconductor layer 13 may include at least one p-type semiconductor layer. For example, the second semiconductor layer 13 may include one semiconductor material selected from InAlGaN, GaN, AlGaN, InGaN, AlN, and InN, and may be a p-type semiconductor layer doped with a second conductive dopant (or p-type dopant) such as Mg. However, the material forming the second semiconductor layer 13 is not limited thereto, and the second semiconductor layer 13 may include various other materials. In an embodiment of the present disclosure, the second semiconductor layer 13 may include a GaN semiconductor material doped with a second conductive dopant (or p-type dopant). The second semiconductor layer 13 may include a lower surface in contact with the second surface of the active layer 12 and an upper surface exposed to the outside in the direction of the length L of the light emitting element LD. The upper surface of the second semiconductor layer 13 may be the other end portion (or upper end portion) of the light emitting element LD.

In an embodiment of the present disclosure, the first semiconductor layer 11 and the second semiconductor layer 13 may have different thicknesses in the direction of the length L of the light emitting element LD. As an example, the first semiconductor layer 11 may have a relatively greater thickness than that of the second semiconductor layer 13 in the direction of the length L of the light emitting element LD. Therefore, the active layer 12 of the light emitting element LD may be positioned closer to the upper surface of the second semiconductor layer 13 than the lower surface of the first semiconductor layer 11.

Although each of the first semiconductor layer 11 and the second semiconductor layer 13 are illustrated as one layer, the present disclosure is not limited thereto. In an embodiment of the present disclosure, each of the first semiconductor layer 11 and the second semiconductor layer 13 may further include at least one layer, for example, a cladding layer and/or a tensile strain barrier reducing (TSBR) layer according to the material of the active layer 12. The TSBR layer may be a strain mitigating layer that is disposed between semiconductor layers having different lattice structures and serves as a buffer for reducing the difference in lattice constant. The TSBR layer may include a p-type semiconductor layer such as p-GaInP, p-AlInP, or p-AlGaInP, but the present disclosure is not limited thereto.

According to an embodiment, the light emitting element LD may further include an additional electrode (hereinafter, referred to as a "first additional electrode") disposed on the second semiconductor layer 13 (e.g., the exposed end of the second semiconductor layer 13), in addition to the first semiconductor layer 11, the active layer 12, and the second semiconductor layer 13. In another embodiment, the light emitting element LD may further include another additional electrode (hereinafter, referred to as a "second additional electrode") disposed at one end (e.g., the exposed end) of the first semiconductor layer 11.

Each of the first and second additional electrodes may be an ohmic contact electrode, but the present disclosure is not limited thereto. According to an embodiment, the first and second additional electrodes may be a Schottky contact electrode. The first and second additional electrodes may include a conductive material. For example, the first and second additional electrodes may include chromium (Cr), titanium (Ti), aluminum (Al), gold (Au), nickel (Ni), and an opaque metal using oxides or alloys thereof alone or in combination, but the present disclosure is not limited thereto. According to an embodiment, the first and second additional electrodes may include a transparent conductive oxide such as indium tin oxide (ITO), indium zinc oxide (IZO), zinc oxide (ZnO), indium gallium zinc oxide (IGZO), or indium tin zinc oxide (ITZO).

Materials included in the first and second additional electrodes may be the same material or different materials. The first and second additional electrodes may be substantially transparent or translucent. Therefore, light generated by the light emitting element LD may transmit through each of the first and second additional electrodes and may be emitted to the outside of the light emitting element LD. According to an embodiment, when light generated by the light emitting element LD is emitted to the outside of the light emitting element LD through a region other than both end portions of the light emitting element LD without transmitting through the first and second additional electrodes, the first and second additional electrodes may include an opaque metal.

In an embodiment of the present disclosure, the light emitting element LD may further include an insulating film INF. However, according to an embodiment, the insulating film INF may be omitted, and may be provided to cover only a portion of the first semiconductor layer 11, the active layer 12, and the second semiconductor layer 13. For example, in some embodiments, the insulating film INF may cover an outer peripheral surface of the first semiconductor layer 11, the active layer 12, and the second semiconductor layer 13.

The insulating film INF may prevent an electrical short circuit that may occur when the active layer 12 comes into contact with a conductive material other than the first and second semiconductor layers 11 and 13 of the same light emitting element LD. Further, the insulating film INF may reduce or minimize surface defects of the light emitting element LD, thereby improving the lifespan and light emission efficiency of the light emitting element LD. Further, when a plurality of light emitting elements LD are closely disposed, the insulating film INF may prevent an unwanted short circuit that may occur between adjacent light emitting elements LD. As long as the active layer 12 can be prevented from having a short circuit with an external conductive material, the presence or absence of the insulating film INF is not limited.

The insulating film INF may be provided to completely surround the outer peripheral surface of the light emitting stack including the first semiconductor layer 11, the active layer 12, and the second semiconductor layer 13.

In the above-described embodiment, the insulating film INF has been described as completely surrounding the outer peripheral surface of each of the first semiconductor layer 11, the active layer 12, and the second semiconductor layer 13, but the present disclosure is not limited thereto. According to an embodiment, when the light emitting element LD includes the first additional electrode, the insulating film INF may completely surround the outer peripheral surface of each of the first semiconductor layer 11, the active layer 12, the second semiconductor layer 13, and the first additional electrode. In another embodiment, the insulating film INF may not completely surround the outer peripheral surface of the first additional electrode, or may surround only a portion of the outer peripheral surface of the first additional electrode and may not surround the remaining outer peripheral surface of the first additional electrode. In an embodiment, when the first additional electrode is disposed at the other end portion (or upper end portion) of the light emitting element LD and the second additional electrode is disposed at one end portion (or lower end portion) of the light emitting element LD, the insulating film INF may expose at least one region of each of the first and second additional electrodes.

The insulating film INF may include a transparent insulating material. For example, the insulating film INF may include at least one insulating material selected from the group consisting of silicon oxide ($SiO_x$), silicon nitride ($SiN_x$), silicon oxynitride (SiON), aluminum oxide ($AlO_x$), and titanium dioxide ($TiO_2$). However, the present disclosure is not limited thereto, and various materials having insulating properties may be used as the material of the insulating film INF. In an embodiment, the insulating film INF may include a double layer.

The above-described light emitting element LD may be used as light emitting sources of various display devices. The light emitting element LD may be manufactured through a surface treatment process. For example, when a plurality of light emitting elements LD are mixed with a fluid solution (or solvent) and supplied to each pixel area (e.g., an emission area of each pixel or an emission area of each subpixel), each of the light emitting elements LD may be surface-treated so that the light emitting elements LD may be uniformly injected without uneven aggregation in the solution.

An emission unit (or light emitting device) including the above-described light emitting element LD may be used in various types of electronic devices requiring a light source, including a display device. For example, when a plurality of light emitting elements LD are disposed in a pixel area of each pixel of the display panel, the light emitting elements LD may be used as a light source of each pixel. However, the field of application of the light emitting element LD is not limited to the above-described examples. For example, the light emitting element LD may be used in other types of electronic devices requiring a light source, such as a lighting device.

Figure 2A:
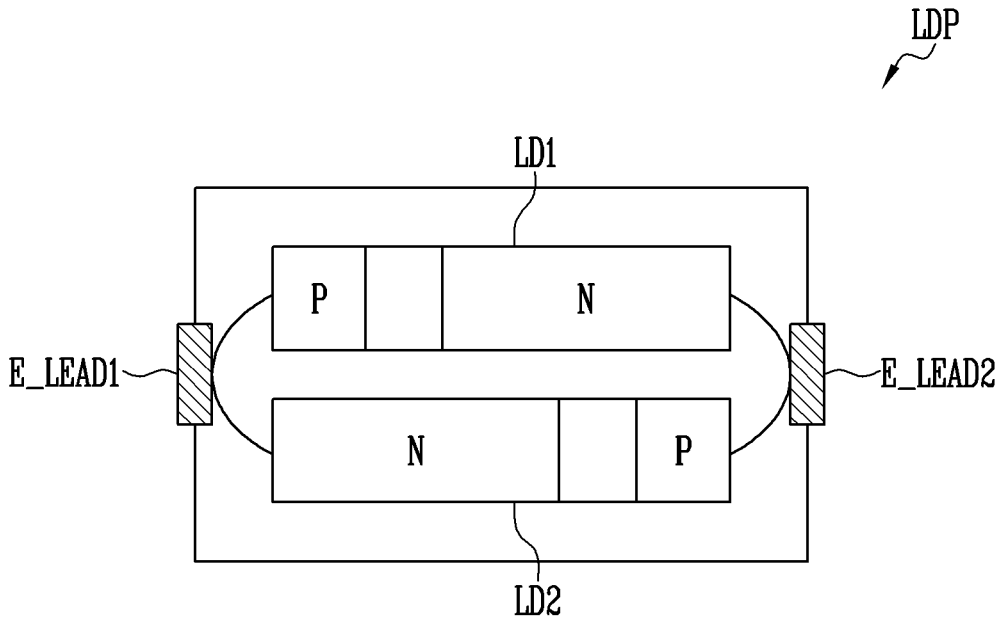
FIG. 2A is a plan view illustrating a light emitting element package according to an embodiment.
Figure 2B:
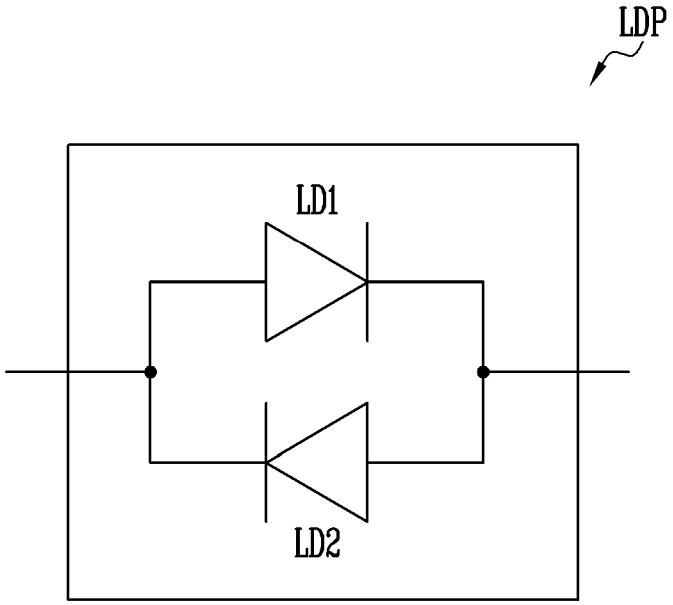
FIG. 2B is an equivalent circuit diagram of the light emitting element package of FIG. 2A.
Figure 2C:
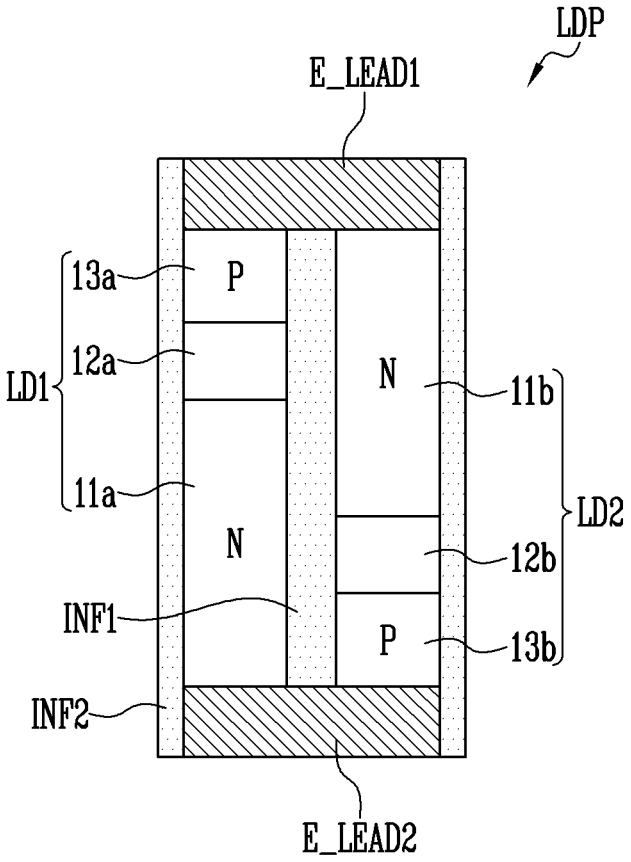
FIG. 2C is a cross-sectional view illustrating an example of the light emitting element package of FIG. 2A.

FIG. 2A is a plan view illustrating a light emitting element package according to an embodiment. FIG. 2B is an equivalent circuit diagram of the light emitting element package of FIG. 2A. FIG. 2C is a cross-sectional view illustrating an example of the light emitting element package of FIG. 2A.

Referring to FIGS. 1A-2C, the light emitting element package LDP may include a first light emitting element LD1, a second light emitting element LD2, a first lead electrode E_LEAD1, and a second lead electrode E_LEAD2.

Each of the first light emitting element LD1 and the second light emitting element LD2 may be substantially identical or similar to the light emitting element LD described above with reference to FIGS. 1A and 1B.

The first light emitting element LD1 and the second light emitting element LD2 may be arranged in different polarity directions (or different current flowing directions).

The first lead electrode E_LEAD1 may be connected to different semiconductor layers of the first light emitting element LD1 and the second light emitting element LD2. The first lead electrode E_LEAD1 may be physically or electrically connected to different semiconductor layers of the first light emitting element LD1 and the second light emitting element LD2. As illustrated in FIG. 2A, the first lead electrode E_LEAD1 may be connected to the p-type semiconductor layer (i.e., the second semiconductor layer 13, see FIG. 1B) of the first light emitting element LD1, and may be connected to the n-type semiconductor layer (i.e., the first semiconductor layer 11, see FIG. 1B) of the second light emitting element LD2.

Similar to the first lead electrode E_LEAD1, the second lead electrode E_LEAD2 may be connected to different semiconductor layers of the first light emitting element LD1 and the second light emitting element LD2. As illustrated in FIG. 2A, the second lead electrode E_LEAD2 may be connected to the n-type semiconductor layer (i.e., the first semiconductor layer 11, see FIG. 1B) of the first light emitting element LD1, and may be connected to the p-type semiconductor layer (i.e., the second semiconductor layer 13, see FIG. 1B) of the second light emitting element LD2.

That is, the first light emitting element LD1 and the second light emitting element LD2 may be connected in different polarity directions (or different current flowing directions) between the first lead electrode E_LEAD1 and the second lead electrode E_LEAD2.

Because the first lead electrode E_LEAD1 and the second lead electrode E_LEAD2 are substantially identical or similar to the first and second additional electrodes described above with reference to FIGS. 1A and 1B, redundant descriptions thereof will not be repeated.

In some embodiments, the first light emitting element LD1 and the second light emitting element LD2 may be integrally formed with each other in the light emitting element package LDP.

As illustrated in FIG. 2C, a first semiconductor layer 11*a*, an active layer 12*a*, and a second semiconductor layer 13*a* of the first light emitting element LD1 may be sequentially stacked on the second lead electrode E_LEAD2. Further, on one side of the first light emitting element LD1 with the first insulating film INF1 therebetween, a second semiconductor layer 13*b*, an active layer 12*b*, and a first semiconductor layer 11*b* of the second light emitting element LD2 may be sequentially stacked on the second lead electrode E_LEAD2. The first lead electrode E_LEAD1 may be disposed on the second semiconductor layer 13*a* of the first light emitting element LD1 and the first semiconductor layer 11*b* of the second light emitting element LD2. The second insulating film INF2 may be provided to completely surround the outer peripheral surface of the light emitting stack including the first light emitting element LD1 and the second light emitting element LD2.

That is, the first light emitting element LD1 and the second light emitting element LD2 may be connected or packaged in different directions and connected to the first lead electrode E_LEAD1 and the second lead electrode E_LEAD2 to constitute one light emitting element package LDP.

For reference, in the case of manufacturing the display device including the light emitting elements (LD, see FIGS. 1A and 1B) having a diameter D and/or a length L of a micro-scale or nano-scale, the light emitting elements LD are prepared in a form dispersed in a solution (e.g., a set or predetermined solution) and are supplied on a substrate (e.g., a pixel area) of the display device through inkjet printing or slit coating. Thereafter, when a voltage (e.g., a set or predetermined voltage) is applied between alignment electrodes previously formed on the substrate, an electric field is formed between the alignment electrodes and the light emitting elements LD are self-aligned between the alignment electrodes. However, in the process of self-aligning the light emitting elements LD, some light emitting elements LD may not be arranged in a desired direction. For example, some light emitting elements LD may be arranged in a direction different from the desired direction (i.e., the desired current flowing direction), and some light emitting elements LD, that is, reverse light emitting elements arranged in a different direction, do not contribute to constituting an effective light source. Further, such reverse light emitting elements do not occur uniformly on the substrate, but may be concentrated in a specific area of the substrate or may occur at different rates for each location. This may be recognized as luminance deviation and cluster dark spots/stains, and the display quality of the display device may be deteriorated.

Therefore, because the light emitting element package LDP according to embodiments of the present disclosure is configured by packaging the first light emitting element LD1 and the second light emitting element LD2 arranged in different polarity directions, the alignment ratio of the light emitting element package LDP may appear uniformly throughout the display device. Therefore, the luminance deviation of the display device may be improved.

Further, the first and second light emitting elements LD1 and LD2 in the light emitting element package LDP alternately emit light through a bidirectional driving technology (i.e., a pixel structure for bidirectional driving) described later, thereby improving the lifespan of the display device.

While, in FIGS. 2A-2C, the light emitting element package LDP has been described as including the pair of the first light emitting element LD1 and the second light emitting element LD2, the light emitting element package LDP is not limited thereto. For example, the light emitting element package LDP may include two or more pairs of first and second light emitting elements LD1 and LD2.

Figure 3:
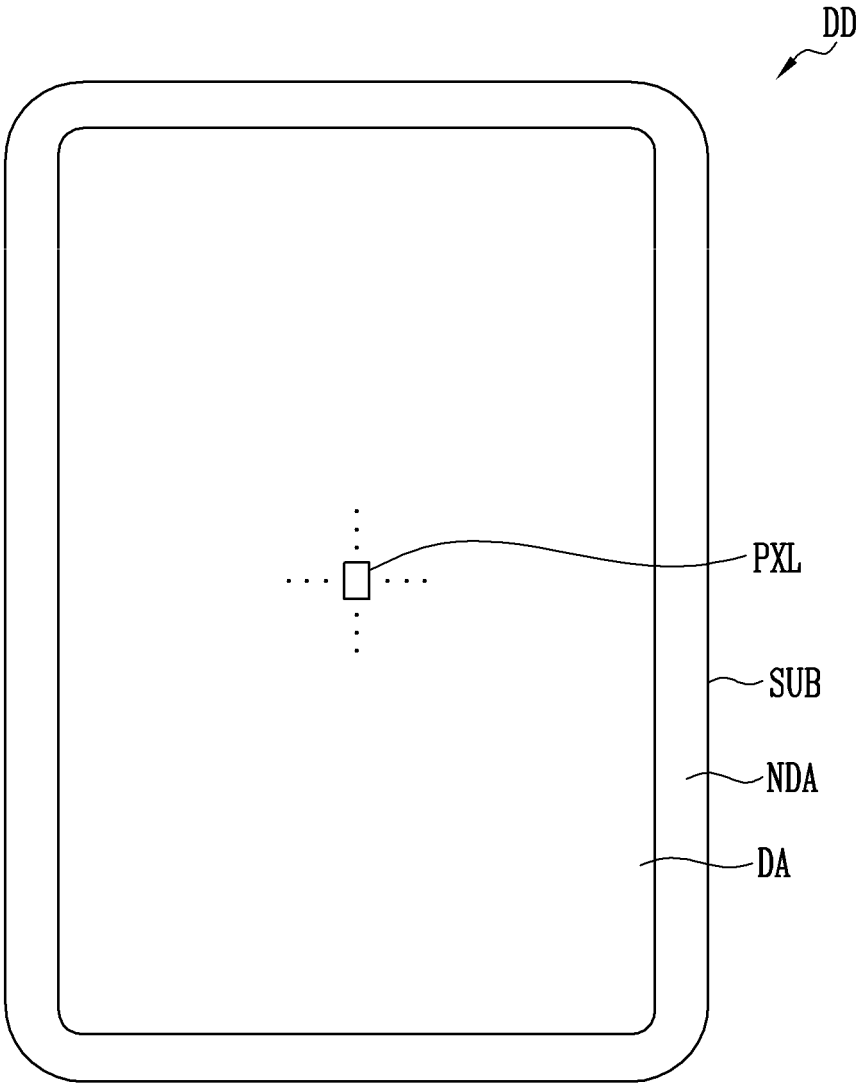
FIG. 3 is a plan view schematically illustrating a display device according to an embodiment.

FIG. 3 is a plan view schematically illustrating a display device according to an embodiment. For example, FIG. 3 is a schematic plan view of a display device using the light emitting elements LD illustrated in FIGS. 1A and 1B or the light emitting element package LDP illustrated in FIGS. 2A-2C as a light source. Because the light emitting element package LDP includes the light emitting element LD, the light emitting element LD and the light emitting element package LDP in the configuration to which the light emitting element LD and the light emitting element package LDP are applied are expressed as the light emitting element LD and will be described below.

In FIG. 3, for convenience, the structure of the display device DD is schematically illustrated centering on the display area DA in which an image is displayed.

Referring to FIGS. 1A-3, the display device DD may include a substrate SUB, a plurality of pixels PXL provided on the substrate SUB and each pixel PXL including at least one light emitting element LD, a driver provided on the substrate SUB and driving the pixels PXL, and a line part connecting the pixels PXL to the driver.

The present disclosure is applicable as long as the display device DD is an electronic device having a display surface applied to at least one surface, such as smart phones, televisions, tablet PCs, mobile phones, video phones, e-book readers, desktop PCs, laptop PCs, netbook computers, workstations, servers, personal digital assistants (PDAs), portable multimedia players (PMPs), MP3 players, medical devices, cameras, or wearable devices.

The display device DD may be classified into a passive matrix type display device and an active matrix type display device according to a method of driving the light emitting element LD. For example, when the display device DD is implemented in an active matrix type, each of the pixels PXL may include a driving transistor for controlling an amount of current supplied to the light emitting element LD, a switching transistor for transmitting a data signal to the driving transistor, and the like.

The display device DD may be provided in various shapes. For example, the display device DD may be provided in a rectangular plate shape having two pairs of sides parallel to each other, but the present disclosure is not limited thereto. When the display device DD is provided in a rectangular plate shape, one pair of the two pairs of sides may be provided to be longer than the other pair thereof. In the display device DD provided in a rectangular plate shape, corner portions where one long side and one short side contact (or meet) each other may have a round shape.

The substrate SUB may include a display area DA and a non-display area NDA.

The display area DA may be an area in which the pixels PXL for displaying an image are provided. The non-display area NDA may be an area in which the driver for driving the pixels PXL and a portion of the line part for connecting the pixels PXL to the driver are provided. For convenience, only one pixel PXL is illustrated in FIG. 3, but substantially a plurality of pixels PXL may be provided in the display area DA of the substrate SUB.

The non-display area NDA may be provided on at least one side of the display area DA. The non-display area NDA may surround the periphery (or edge) of the display area DA. In the non-display area NDA, the line part connected to the pixels PXL, and the driver connected to the line part and driving the pixels PXL may be provided.

The line part may electrically connect the driver to the pixels PXL. The line part may be a fan-out line that provides a signal to each pixel PXL and is connected to signal lines connected to each pixel PXL, for example, a scan line, a data line, or an emission control line. Further, the line part may be a fan-out line that is connected to signal lines connected to each pixel PXL, for example, a control line or a sensing line in order to compensate for changes in electrical characteristics of each pixel PXL in real time.

The substrate SUB may include a transparent insulating material and thus may transmit light. The substrate SUB may be a rigid substrate or a flexible substrate.

One area on the substrate SUB may be provided as the display area DA on which the pixels PXL are disposed, and the remaining area on the substrate SUB may be provided as the non-display area NDA. For example, the substrate SUB may include the display area DA including pixel areas in which each pixel PXL is disposed, and the non-display area NDA disposed around the display area DA (or adjacent to the display area DA).

Each of the pixels PXL may be provided in the display area DA on the substrate SUB. In an embodiment of the present disclosure, the pixels PXL may be arranged in the display area DA in a stripe arrangement structure or a PENTILE® arrangement structure, but the present disclosure is not limited thereto. This PENTILE® arrangement structure may be referred to as an RGBG matrix structure (e.g., a PENTILE® matrix structure or an RGBG structure (e.g., a PENTILE® structure)). PENTILE® is a registered trademark of Samsung Display Co., Ltd., Republic of Korea.

Each of the pixels PXL may include at least one light emitting element LD driven by a corresponding scan signal and a corresponding data signal. The light emitting element LD has a size as small as micro-scale or nano-scale, and may be connected in parallel with light emitting elements disposed adjacent to each other, but the present disclosure is not limited thereto. The light emitting element LD may constitute a light source for each pixel PXL.

Each of the pixels PXL may include at least one light source driven by a signal (e.g., a set or predetermined signal) (e.g., a scan signal and a data signal) and/or a voltage (e.g., a set or predetermined voltage) (e.g., a first driving voltage and a second driving voltage), for example, the light emitting elements LD illustrated in FIGS. 1A and 1B. However, in an embodiment of the present disclosure, the type of the light emitting element LD that is usable as a light source for each pixel PXL is not limited thereto.

The driver may provide a signal (e.g., a set or predetermined signal) and a voltage (e.g., a set or predetermined voltage) to each pixel PXL through the line part, and may control the driving of the pixel PXL accordingly. The driver may include a scan driver, an emission driver, a data driver, and a timing controller.

Figure 4A:
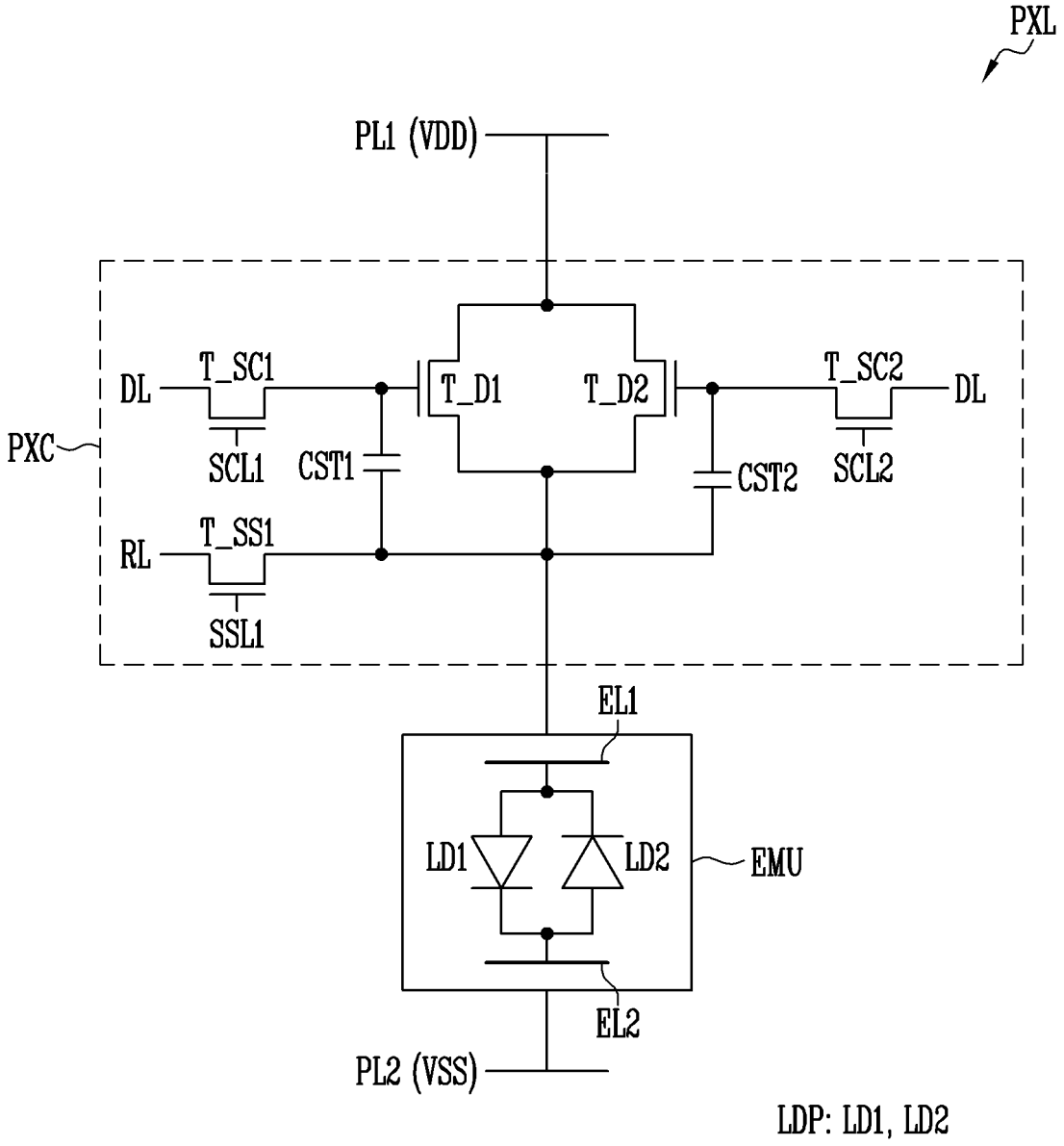
FIGS. 4A and 4B are circuit diagrams illustrating an embodiment of a pixel included in the display device of FIG. 3.
Figure 4B:
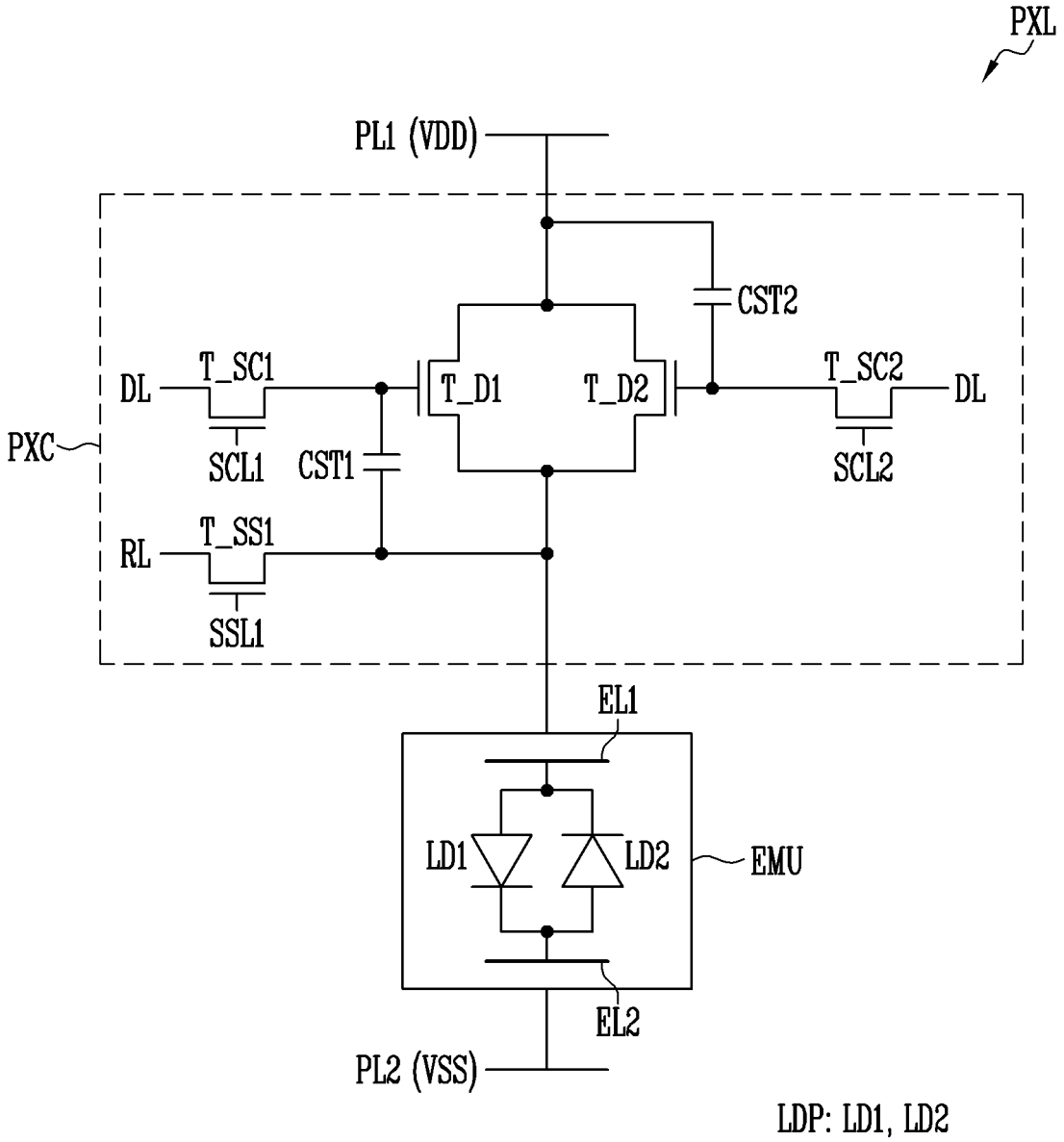

FIGS. 4A and 4B are circuit diagrams illustrating an embodiment of a pixel included in the display device of FIG. 3. FIGS. 4A and 4B show an electrical connection relationship between elements included in one pixel PXL illustrated in FIG. 3.

In FIGS. 4A and 4B, not only the elements included in each of the pixels illustrated in FIG. 3 but also the region in which the elements are provided are referred to as a pixel PXL.

Referring to FIGS. 1A-4B, one pixel PXL (hereinafter, referred to as a "pixel") may include an emission unit EMU for generating light having a luminance corresponding to a data signal. Further, the pixel PXL may optionally further include a pixel circuit PXC for driving the emission unit EMU.

The emission unit EMU may include a plurality of light emitting elements LD connected in parallel between a first power line PL1 and a second power line PL2. A first driving voltage VDD (or a first power supply voltage) may be applied to the first power line PL1, and a second driving voltage VSS (or a second power supply voltage) may be applied to the second power line PL2. The first driving voltage VDD and the second driving voltage VSS may have different potentials. As an example, the first driving voltage VDD may be set as a high potential voltage, and the second driving voltage VSS may be set as a low potential voltage. According to an embodiment, the first driving voltage VDD may be set as a low potential voltage, and the second driving voltage VSS may be set as a high potential voltage.

For example, the emission unit (EMU) may include a first electrode EL1 (or a "first alignment electrode") connected to the first driving voltage VDD through the pixel circuit PXC and the first power line PL1, a second electrode EL2 (or a "second alignment electrode") connected to the second driving voltage VSS through the second power line PL2, and a first light emitting element LD1 and a second light emitting element LD2 connected in parallel between the first and second electrodes EL1 and EL2 in different directions (or polarity direction, current flowing direction, etc.). The first light emitting element LD1 and the second light emitting element LD2 may constitute the light emitting element package LDP, as described above with reference to FIGS. 2A-2C. That is, the emission unit EMU may include the light emitting element package LDP.

The first light emitting element LD1 included in the emission unit EMU may include one end portion connected to the first driving voltage VDD through the first electrode EL1, and the other end portion connected to the second driving voltage VSS through the second electrode EL2. The second light emitting element LD2 included in the emission unit EMU may include one end portion connected to the second driving voltage VSS through the second electrode EL2, and the other end portion connected to the first driving voltage VDD through the first electrode EL1.

The first light emitting element LD1 and the second light emitting element LD2 (or the light emitting element package LDP) connected in parallel in different directions between the first electrode EL1 and the second electrode EL2 to which the voltages of different potentials are respectively supplied may constitute an effective light source. As will be described later, the first light emitting element LD1 may constitute an effective light source in a first mode, and the second light emitting element LD2 may constitute an effective light source in a second mode. These effective light sources may be collected to form the emission unit EMU of the pixel PXL. The first mode may be defined as a mode in which the first light emitting element LD1 emits light, and the second mode may be defined as a mode in which the second light emitting element LD2 emits light.

The light emitting elements LD of the emission unit EMU may emit light having a luminance corresponding to a driving current supplied through the pixel circuit PXC. For example, during each frame period, the pixel circuit PXC may supply, to the emission unit EMU, a driving current corresponding to a gray scale value of the corresponding frame data. The driving current supplied to the emission unit EMU may flow to the first light emitting element LD1 or the second light emitting element LD2. While the first light emitting element LD1 or the second light emitting element LD2 emits light having a luminance corresponding to a current flowing therethrough, the emission unit EMU may emit light having a luminance corresponding to the driving current.

For example, when a driving current flowing in a first current flowing direction is supplied to the emission unit EMU, the first light emitting element LD1 may emit light. The second light emitting element LD2 maintains an inactive state even when a driving voltage (e.g., a set or predetermined driving voltage) (e.g., a forward driving voltage) is applied between the first and second electrodes EL1 and EL2. Therefore, no current substantially flows through the second light emitting element LD2. As another example, when a driving current flowing in a second current flowing direction is supplied to the emission unit EMU, the second light emitting element LD2 may emit light. The first light emitting element LD1 maintains an inactive state even when a driving voltage (e.g., a set or predetermined driving voltage) (e.g., a reverse driving voltage) is applied between the first and second electrodes EL1 and EL2. Therefore, no current substantially flows through the first light emitting element LD1.

A more specific embodiment of the emission unit EMU will be described later with reference to FIGS. 5A-5C.

The pixel circuit PXC may be connected between the first power line PL1 and the emission unit EMU, may provide the first driving current to the emission unit EMU in the first current flowing direction in the first mode, and may provide the second driving current to the emission unit EMU in the second current flowing direction in the second mode.

The pixel circuit PXC may be connected to a first scan line SCL1, a second scan line SCL2, a readout line RL, and a data line DL of the pixel PXL.

According to an embodiment, the pixel circuit PXC may include a first driving transistor T_D1, a first scan transistor T_SC1, a first storage capacitor CST1, and a first sensing transistor T_SS1. The pixel circuit PXC may further include a second driving transistor T_D2, a second scan transistor T_SC2, and a second storage capacitor CST2.

A first terminal of the first driving transistor T_D1 may be electrically connected to the first power line PL1, and a second terminal of the first driving transistor T_D1 may be electrically connected to the first electrode EL1 of the emission unit EMU. The first terminal of the first driving transistor T_D1 may be a drain electrode, and the second terminal of the first driving transistor T_D1 may be a source electrode. A gate electrode of the first driving transistor T_D1 may be connected to the second terminal of the first scan transistor T_SC1. The first driving transistor T_D1 controls the amount of the first driving current (i.e., the driving current flowing in the first current flowing direction) supplied to the emission unit EMU in response to a voltage applied to the gate electrode of the first driving transistor T_D1.

The first terminal of the first scan transistor T_SC1 may be electrically connected to the data line DL, and the second terminal of the first scan transistor T_SC1 may be electrically connected to the gate electrode of the first driving transistor T_D1. The first terminal and the second terminal of the first scan transistor T_SC1 may be different terminals. For example, when the first terminal is a source electrode, the second terminal may be a drain electrode. The gate electrode of the first scan transistor T_SC1 may be connected to the first scan line SCL1. When a first scan signal of a voltage (e.g., a high voltage) at which the first scan transistor T_SC1 can be turned on is supplied from the first scan line SCL1, the first scan transistor T_SC1 is turned on to electrically connect the data line DL to the gate electrode of the first driving transistor T_D1. In this case, the data signal of the frame is supplied to the data line DL, and accordingly, the data signal is transmitted to the gate electrode of the first driving transistor T_D1.

The first terminal of the first sensing transistor T_SS1 may be electrically connected to the readout line RL, and the second terminal of the first sensing transistor T_SS1 may be electrically connected to the second terminal of the first driving transistor T_D1 (or the first electrode EL1 of the emission unit EMU). The gate electrode of the first sensing transistor T_SS1 may be connected to the first sensing line SSL1. When a first scan signal of a voltage (e.g., a high voltage) at which the first sensing transistor T_SS1 can be turned on is supplied from the first sensing line SSL1, the first sensing transistor T_SS1 is turned on to electrically connect the readout line RL to the second terminal of the first driving transistor T_D1. In this case, an initialization voltage is supplied to the readout line RL, and accordingly, the initialization voltage is applied to the second terminal of the first driving transistor T_D1. The initialization voltage may be set to have a voltage level at which the emission unit EMU does not emit light in relation to the second power line PL2.

The first storage capacitor CST1 may be formed between the gate electrode and the second terminal of the first driving transistor T_D1. One electrode of the first storage capacitor CST1 may be connected to the gate electrode of the first driving transistor T_D1, and the other electrode of the first storage capacitor CST1 may be connected to the second terminal of the first driving transistor T_D1 (or the first electrode EL1 of the emission unit EMU).

The first storage capacitor CST1 charges a voltage (or stores a charge) corresponding to a data signal supplied to the gate electrode of the first driving transistor T_D1 (e.g., a voltage or charge corresponding to the difference between the data voltage and the initialization voltage), and maintains the charged voltage until a data signal of a next frame is supplied.

A first terminal of the second driving transistor T_D2 may be electrically connected to the first power line PL1, and a second terminal of the second driving transistor T_D2 may be electrically connected to the first electrode EL1 of the emission unit EMU. The first terminal of the second driving transistor T_D2 may be a source electrode, and the second terminal of the second driving transistor T_D2 may be a drain electrode. However, in some embodiments, the first terminal of the second driving transistor T_D2 may be a drain electrode, and the second terminal of the second driving transistor T_D2 may be a source electrode. A gate electrode of the second driving transistor T_D2 may be connected to the second terminal of the second scan transistor T_SC2. The second driving transistor T_D2 controls the amount of the second driving current (i.e., the driving current flowing in the second current flowing direction opposite to the first current flowing direction) supplied to the emission unit EMU in response to a voltage applied to the gate electrode.

The first terminal of the second scan transistor T_SC2 may be electrically connected to the data line DL, and the second terminal of the second scan transistor T_SC2 may be electrically connected to the gate electrode of the second driving transistor T_D2. The gate electrode of the second scan transistor T_SC2 may be connected to the second scan line SCL2. When a second scan signal of a voltage (e.g., a high voltage) at which the second scan transistor T_SC2 can be turned on is supplied from the second scan line SCL2, the second scan transistor T_SC2 is turned on to electrically connect the data line DL to the gate electrode of the second driving transistor T_D2. In this case, the data signal of the frame is supplied to the data line DL, and accordingly, the data signal is transmitted to the gate electrode of the second driving transistor T_D2.

The second storage capacitor CST2 may be formed between the gate electrode and the second terminal of the second driving transistor T_D2. One electrode of the second storage capacitor CST2 may be connected to the gate electrode of the second driving transistor T_D2, and the other electrode of the second storage capacitor CST2 may be connected to the second terminal of the second driving transistor T_D2 (or the first electrode EL1 of the emission unit EMU).

The second storage capacitor CST2 charges a voltage (or stores a charge) corresponding to a data signal supplied to the gate electrode of the second driving transistor T_D2 (e.g., a voltage or charge corresponding to the difference between the data voltage and the initialization voltage), and maintains the charged voltage until a data signal of a next frame is supplied.

While, in FIG. 4A, the second storage capacitor CST2 has been described as being formed between the gate electrode and the second terminal of the second driving transistor T_D2, the second storage capacitor CST2 is not limited thereto. As illustrated in FIG. 4B, the second storage capacitor CST2 may be formed between the gate electrode and the first terminal of the second driving transistor T_D2. In this case, the second storage capacitor CST2 charges a voltage (or stores a charge) corresponding to a data signal supplied to the gate electrode of the second driving transistor T_D2

(e.g., a voltage or a charge corresponding to the difference between the data voltage and the voltage applied to the first power line PL1), and maintains the charged voltage until a data signal of a next frame is supplied.

While, in FIGS. 4A and 4B, transistors included in the pixel circuit PXC, for example, the first driving transistor T_D1, the first scan transistor T_SC1, the first sensing transistor T_SS1, the second driving transistor (T_D2), and the second scan transistor T_SC2, are all illustrated as N-type transistors, but the present disclosure is not limited thereto. That is, at least one of the first driving transistor T_D1, the first scan transistor T_SC1, the first sensing transistor T_SS1, the second driving transistor T_D2, and the second scan transistor T_SC2, which are included in the pixel circuit PXC, may be changed to a P-type transistor. Further, one of ordinary skill in the art would appreciate any necessary changes to circuitry and applied voltages when a P-type transistor is used.

As described above, the pixel circuit PXC of the pixel PXL may provide the first driving current to the emission unit EMU in the first current flowing direction in the first mode, and may provide the second driving current to the emission unit EMU in the second current flowing direction in the second mode. Therefore, in the first mode, the first light emitting element LD1 in the emission unit EMU may emit light, and in the second mode, the second light emitting element LD2 in the emission unit EMU may emit light. When the first mode and the second mode alternate in a specific period, the first light emitting element LD1 and the second light emitting element LD2 alternately emit light. The lifespan of the emission unit EMU may be improved, compared with the case in which only the first light emitting element LD1 or the second light emitting element LD2 emits light in response to one current direction.

Figure 5A:
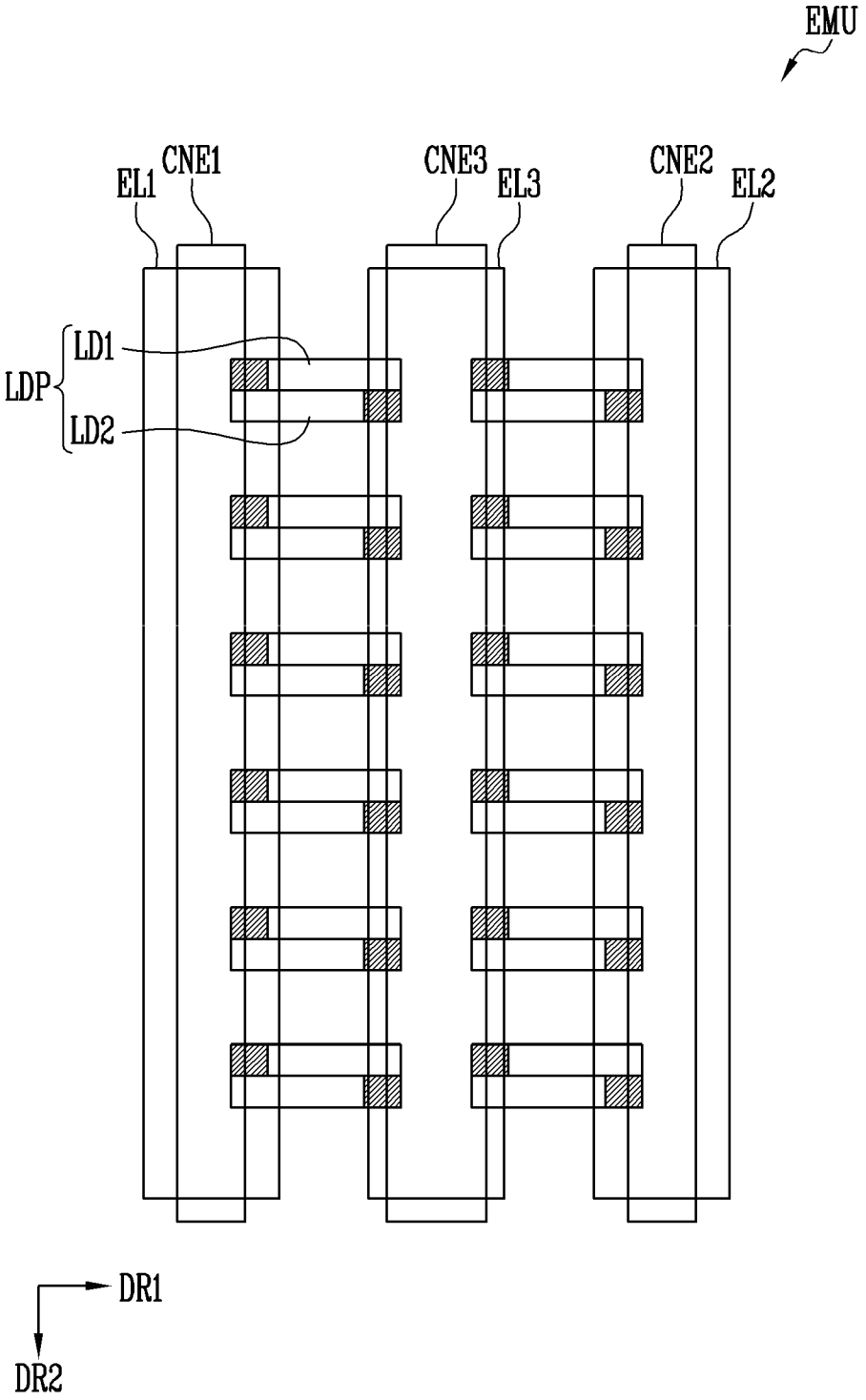
FIG. 5A is a plan view illustrating an example of an emission unit included in the pixel of FIGS. 4A and 4B.

FIG. 5A is a plan view illustrating an example of the emission unit included in the pixels of FIGS. 4A and 4B. FIG. 5B is an equivalent circuit diagram of the emission unit of FIG. 5A. FIG. 5C is a plan view illustrating another example of the emission unit included in the pixels of FIGS. 4A and 4B.

Referring to FIGS. 1A-5B, the emission unit EMU may be formed in a specific area on the substrate SUB (see FIG. 3). For example, the emission unit EMU may be formed in the pixel area corresponding to one pixel PXL.

The pixel PXL may include a first electrode EL1, a second electrode EL2, and a third electrode EL3 (or a middle electrode), which are physically separated or spaced from each other. The first electrode EL1 and the second electrode EL2 may correspond to the first electrode EL1 and the second electrode EL2 described above with reference to FIGS. 4A and 4B, respectively.

The first electrode EL1, the third electrode EL3, and the second electrode EL2 may be sequentially arranged along the first direction DR1. That is, the first electrode EL1 and the second electrode EL2 may be spaced from each other in the first direction DR1, and the third electrode EL3 may be disposed between the first electrode EL1 and the second electrode EL2.

Each of the first electrode EL1, the second electrode EL2, and the third electrode EL3 may extend in the second direction DR2 crossing the first direction DR1.

However, the first electrode EL1, the second electrode EL2, and the third electrode EL3 are not limited thereto. For example, the shape and/or mutual arrangement relationship of the first electrode EL1, the second electrode EL2, and the third electrode EL3 may be variously changed. For example, the first electrode EL1, the second electrode EL2, and the third electrode EL3 may have a partially curved shape.

The first electrode EL1 may be connected to the first driving transistor T_D1 and the second driving transistor T_D2 described above with reference to FIG. 4A through a first contact hole, and the second electrode EL2 may be connected to the second power line PL2 (or the second driving voltage VSS) described above with reference to FIG. 4A through a second contact hole.

According to an embodiment, each of the first electrode EL1, the second electrode EL2, and the third electrode EL3 may have a single layer structure or a multilayer structure. For example, the first electrode EL1, the second electrode EL2, and the third electrode EL3 may have a multilayer structure including a reflective electrode and a conductive capping layer. Further, the reflective electrode may have a single layer structure or a multilayer structure. As an example, the reflective electrode may include at least one reflective conductive layer, and at least one transparent conductive layer disposed above and/or below the reflective conductive layer may be optionally further included.

The emission unit EMU may include at least one pair of the first light emitting element LD1 and the second light emitting element LD2. That is, the emission unit EMU may include a light emitting element package LDP.

The first light emitting element LD1 and the second light emitting element LD2 may be disposed between the first electrode EL1 and the third electrode EL3 in different directions. Between the first electrode EL1 and the third electrode EL3, the first end portion (e.g., the p-type semiconductor layer) of the first light emitting element LD1 may face the first electrode EL1, and the second end portion (e.g., the n-type semiconductor layer) of the first light emitting element LD1 may face the third electrode EL3. Between the first electrode EL1 and the third electrode EL3, the first end portion (e.g., the p-type semiconductor layer) of the second light emitting element LD2 may face the third electrode EL3, and the second end portion (e.g., the n-type semiconductor layer) of the second light emitting element LD2 may face the first electrode EL1.

In other words, one electrode (e.g., the first lead electrode E_LEAD1, see FIG. 2A) of the light emitting element package LDP may face the first electrode EL1, and the other electrode (e.g., the second lead electrode E_LEAD2, see FIG. 2A) of the light emitting element package LDP may face the third electrode EL3.

Figure 5B:
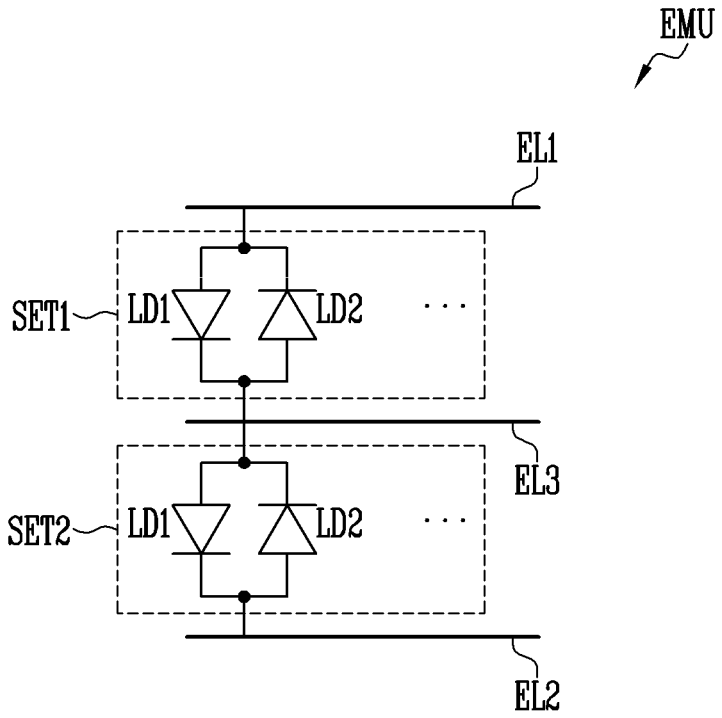
FIG. 5B is an equivalent circuit diagram of the emission unit of FIG. 5A.
Figure 5C:
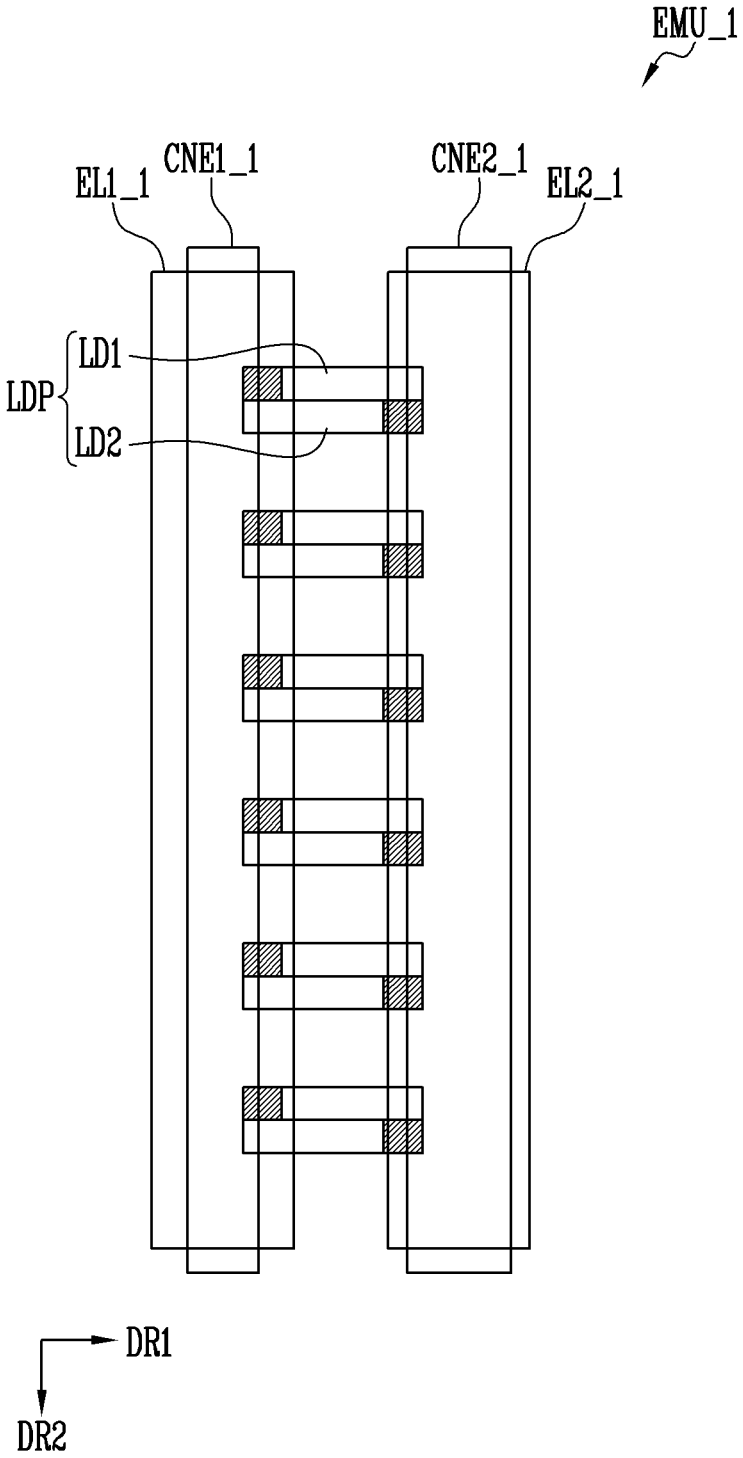
FIG. 5C is a plan view illustrating another example of an emission unit included in the pixels of FIGS. 4A and 4B.

When a plurality of first light emitting elements LD1 and a plurality of second light emitting elements LD2 are provided, the plurality of first light emitting elements LD1 are mutually connected in parallel between the first electrode EL1 and the third electrode EL3 in the first current flowing direction, and the plurality of second light emitting elements LD2 are mutually connected in parallel between the first electrode EL1 and the third electrode EL3 in the second current flowing direction, thereby constituting a first stage SET1 illustrated in FIG. 5B.

Further, the first light emitting element LD1 and the second light emitting element LD2 may be disposed between the third electrode EL3 and the second electrode EL2 in different directions. The arrangement of the first light emitting element LD1 and the second light emitting element LD2 between the third electrode EL3 and the second electrode EL2 is substantially identical or similar to the arrangement of the first light emitting element LD1 and the second light emitting element LD2 between the first electrode EL1 and the third electrode EL3, redundant descriptions thereof will not be repeated.

When a plurality of first light emitting elements LD1 and a plurality of second light emitting elements LD2 are provided, the plurality of first light emitting elements LD1 are mutually connected in parallel between the third electrode EL3 and the second electrode EL2 in the first current flowing direction, and the plurality of second light emitting elements LD2 are mutually connected in parallel between the third electrode EL3 and the second electrode EL2 in the second current flowing direction, thereby constituting a second stage SET2 illustrated in FIG. 5B.

While in FIG. 5A, the first light emitting element LD1 and the second light emitting element LD2 (or the light emitting element package LDP) are illustrated as being aligned among the first electrode EL1, the second electrode EL2, and the third electrode EL3 in the first direction DR1, but the present disclosure is not limited thereto. For example, light emitting elements may be further arranged among the first electrode EL1, the second electrode EL2, and the third electrode EL3 in a diagonal direction.

The first light emitting element LD1 and the second light emitting element LD2 may be electrically connected between the first electrode EL1 and the second electrode EL2.

In an embodiment, between the first electrode EL1 and the third electrode EL3, the first end portion of the first light emitting element LD1 may be electrically connected to the first electrode EL1 through at least one contact electrode, for example, the first contact electrode CNE1. Similarly, the second end portion of the second light emitting element LD2 may be electrically connected to the first electrode EL1 through the first contact electrode CNE1.

Further, between the first electrode EU and the third electrode EL3, the second end portion of the first light emitting element LD1 and the first end portion of the second light emitting element LD2 may be connected to the third electrode EL3 through the third contact electrode CNE3. Similarly, between the third electrode EL3 and the second electrode EL2, the first end portion of the first light emitting element LD1 and the second end portion of the second light emitting element LD2 may be connected to the third electrode EL3 through the third contact electrode CNE3. However, the present disclosure is not limited thereto. The third contact electrode CNE3 may not be connected to the third electrode EL3.

Further, between the third electrode EL3 and the second electrode EL2, the second end portion of the first light emitting element LD1 and the first end portion of the second light emitting element LD2 may be electrically connected to the second electrode EL2 through the second contact electrode CNE2.

According to an embodiment, the first light emitting element LD1 and the second light emitting element LD2 (or the light emitting element package LDP) may be prepared in a form dispersed in a solution (e.g., a set or predetermined solution), and may be supplied to the pixel area through inkjet printing or slit coating. For example, the first light emitting element LD1 and the second light emitting element LD2 (or the light emitting element package LDP) may be mixed with a volatile solvent and supplied to the pixel area. In this case, when a voltage (e.g., a set or predetermined voltage) is applied between the first electrode EL1 and the third electrode EL3 and between the third electrode EL3 and the second electrode EL2, an electric field is formed between the first electrode EL1 and the third electrode EL3 and between the third electrode EL3 and the second electrode EL2, and the first light emitting element LD1 and the second light emitting element LD2 (or the light emitting element package LDP) are self-aligned among the first electrode EL1, the second electrode EL2, and the third electrode EL3. By volatilizing the solvent after the first light emitting element LD1 and the second light emitting element LD2 (or the light emitting element package LDP) are aligned, or removing the solvent in any other methods, the first light emitting element LD1 and the second light emitting element LD2 (or the light emitting element package LDP) may be stably arranged among the first electrode EL1, the second electrode EL2, and the third electrode EL3.

When one pair of the first light emitting element LD1 and the second light emitting element LD2 constitute the light emitting element package LDP, the ratio of the first light emitting element LD1 arranged in the first current flowing direction and the second light emitting element LD2 arranged in the second current flowing direction may be equal to 1:1. That is, the total number of first light emitting elements LD1 in the emission unit EMU may be substantially the same as the total number of second light emitting elements LD2.

Therefore, the luminance of the display device may appear uniformly throughout the display device.

Further, because the alignment direction (e.g., the forward direction or the reverse direction) in the light emitting element package LDP is not relevant, a process for improving the degree of alignment of each of the light emitting elements having only a specific polarity direction may not be required in aligning the light emitting element package LDP. That is, because the configuration for increasing the degree of alignment of the light emitting element package LDP is not required, the manufacturing process may be simplified.

Furthermore, the luminance of the first light emitting element LD1 emitting light in the first mode and the luminance of the second light emitting element LD2 emitting light in the second mode may be equal to each other. Therefore, even when the pixels PXL alternately operate in the first mode and the second mode, the change in luminance may not occur when the mode of the pixels PXL is switched.

While, in FIGS. 5A and 5B, the emission unit EMU has been described as including the first stage SET1 and the second stage SET2 connected in series, the present disclosure is not limited thereto. As illustrated in FIG. 5C, an emission unit EMU_1 may include first and second electrodes EL1_1 and EL2_1, first and second light emitting elements LD1 and LD2 disposed between the first and second electrodes EL1_1 and EL2_1, a first contact electrode CNE1_1 connecting a first end portion of the first light emitting element LD1 and a second end portion of the second light emitting element LD2 to the first electrode EL1_1, and a second contact electrode CNE2_1 connecting a second end portion of the first light emitting element LD1 and a first end portion of the second light emitting element LD2 to the second electrode EL2_1. That is, the first light emitting element LD1 and the second light emitting element LD2 in the emission unit EMU may be connected in parallel in different directions. Alternatively, the emission unit EMU may include a light emitting element package LDP connected in a serial/parallel hybrid structure in various ways.

Figure 6A:
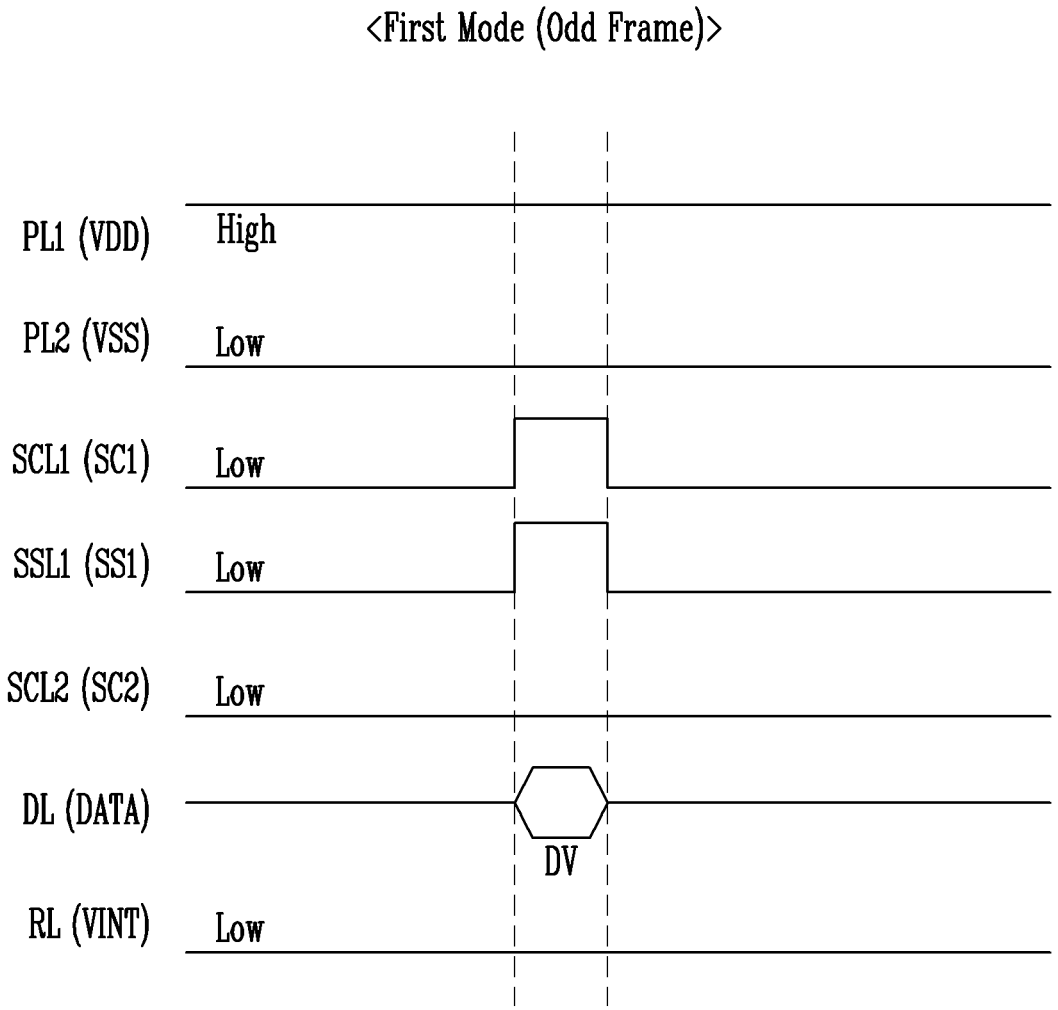
FIGS. 6A-6C are diagrams illustrating an example of the operations of the pixels of FIGS. 4A and 4B.
Figure 6B:
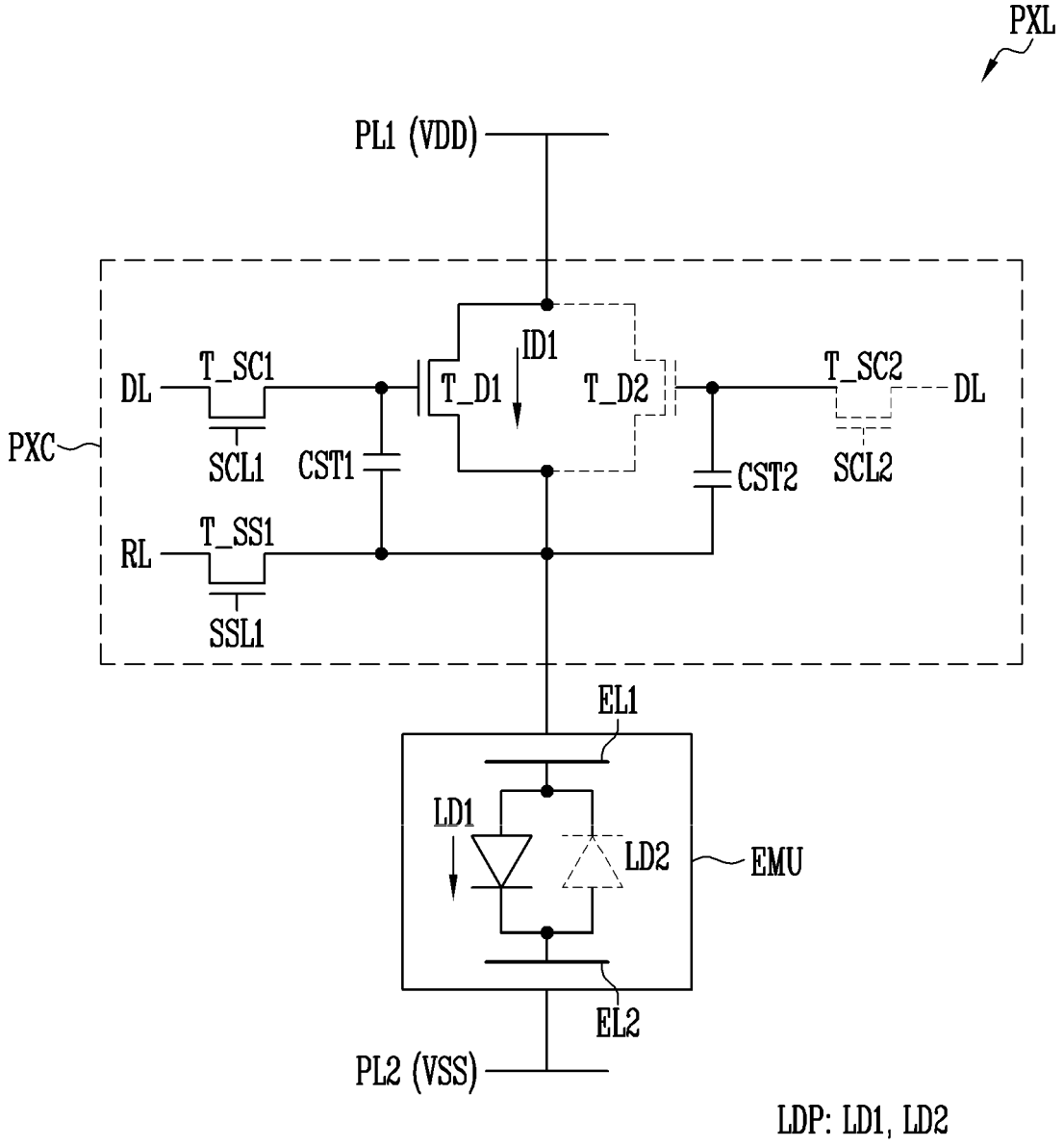
Figure 6C:
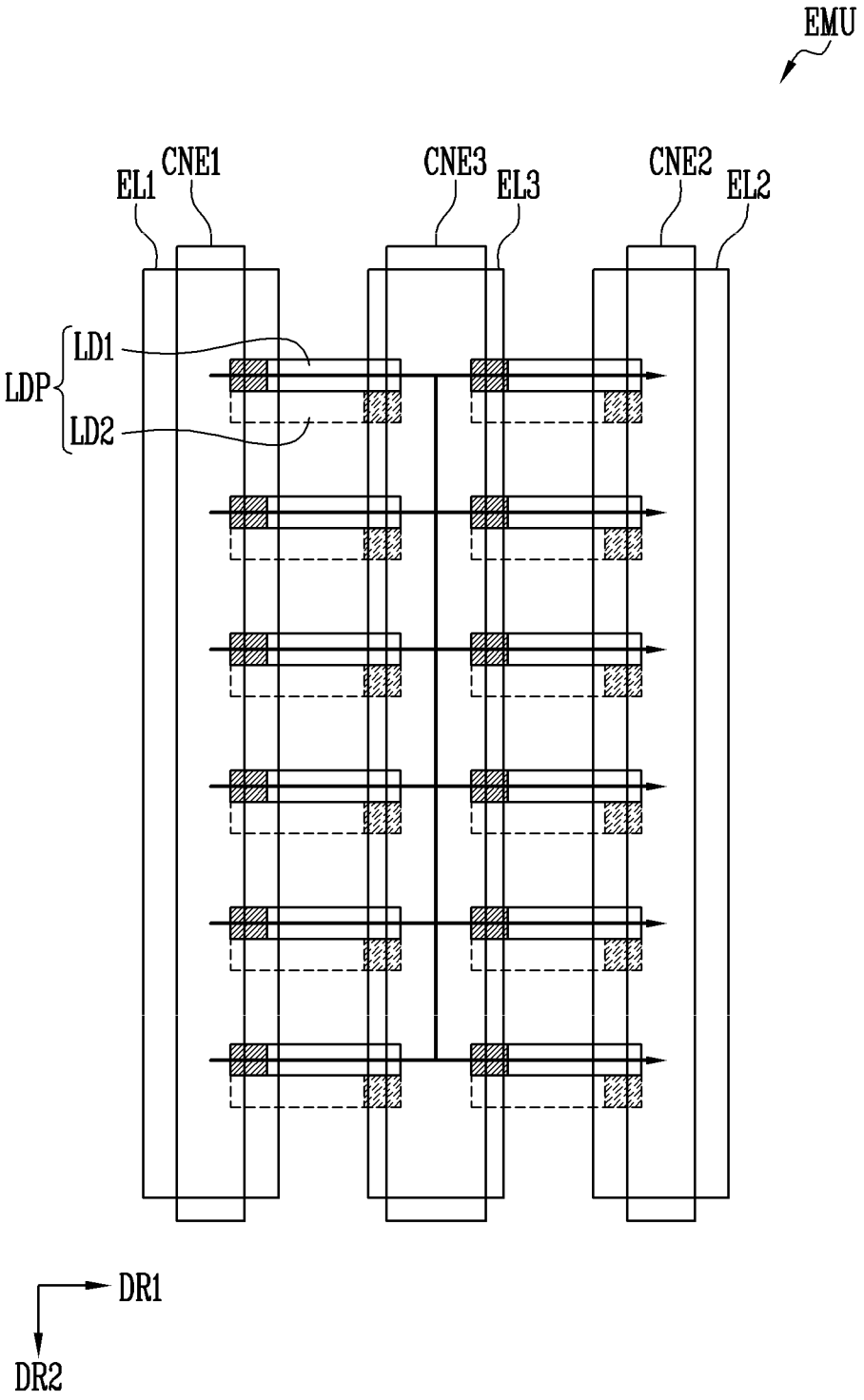

FIGS. 6A-6C are diagrams illustrating an example of the operations of the pixels of FIGS. 4A and 4B. FIGS. 6A-6C illustrate a timing diagram for the operations of the pixels PXL of FIGS. 4A and 4B in the first mode, a circuit diagram of the pixel PXL, and the operation of the emission unit EMU accordingly.

Referring to FIGS. 4A-6C, it will be described that the pixel PXL is driven in the first mode in an odd frame from among a plurality of frames (or frame sections). However, this is only an example, and the pixel PXL may be driven in the first mode during two or more consecutive frames.

In the first mode, the first driving voltage VDD having the high level (or high potential) may be applied to the first power line PL1. The second driving voltage VSS having the low level (or low potential) may be applied to the second power line PL2.

A first scan signal SC1 applied to the first scan line SCL1 may have a high level (or a turn-on voltage level, a gate-on voltage level, etc.). In this case, the first scan transistor T_SC1 may be turned on, and the data voltage DV applied to the data line DL may be applied to the gate electrode of the first driving transistor T_D1.

At the same time, the first sensing signal SS1 applied to the first sensing line SSL1 may have the high level. In this case, the first sensing transistor T_SS1 may be turned on, and the initialization voltage VINT applied to the readout line RL may be applied to the second terminal (or source electrode) of the first driving transistor T_D1.

The first storage capacitor CST1 may store the voltage (or charge) corresponding to the difference between the data voltage DV and the initialization voltage VINT. While the data voltage DV is being written to the first storage capacitor CST1, the emission unit EMU may not emit light due to the initialization voltage VINT.

When the first scan signal SC1 and the first sensing signal SS1 change from the high level to the low level, the first driving transistor T_D1 may supply a first driving current ID1 flowing in the first current flowing direction to the emission unit EMU in response to the voltage (or charge) stored in the first storage capacitor CST1.

In this case, the first driving current ID1 may flow through the first light emitting element LD1 arranged in the first current flowing direction in the emission unit EMU, and the first light emitting element LD1 may emit light having a luminance corresponding to the first driving current ID1.

In the first mode, a second scan signal SC2 applied to the second scan line SCL2 may be maintained at the low level (or the turn-off voltage level, the gate-off voltage level, etc.). Therefore, the second scan transistor T_SC2 may maintain a turned-off state, and the data voltage DV may not be applied to the gate electrode of the second driving transistor T_D2. Further, because the first driving current ID1 does not flow through the second light emitting element LD2 arranged in the second current flowing direction in the emission unit EMU, the second light emitting element LD2 may not emit light.

As illustrated in FIG. 6C, because the first light emitting element LD1 in the emission unit EMU emit uniform light, cluster dark spots or stains may not occur.

Figure 7A:
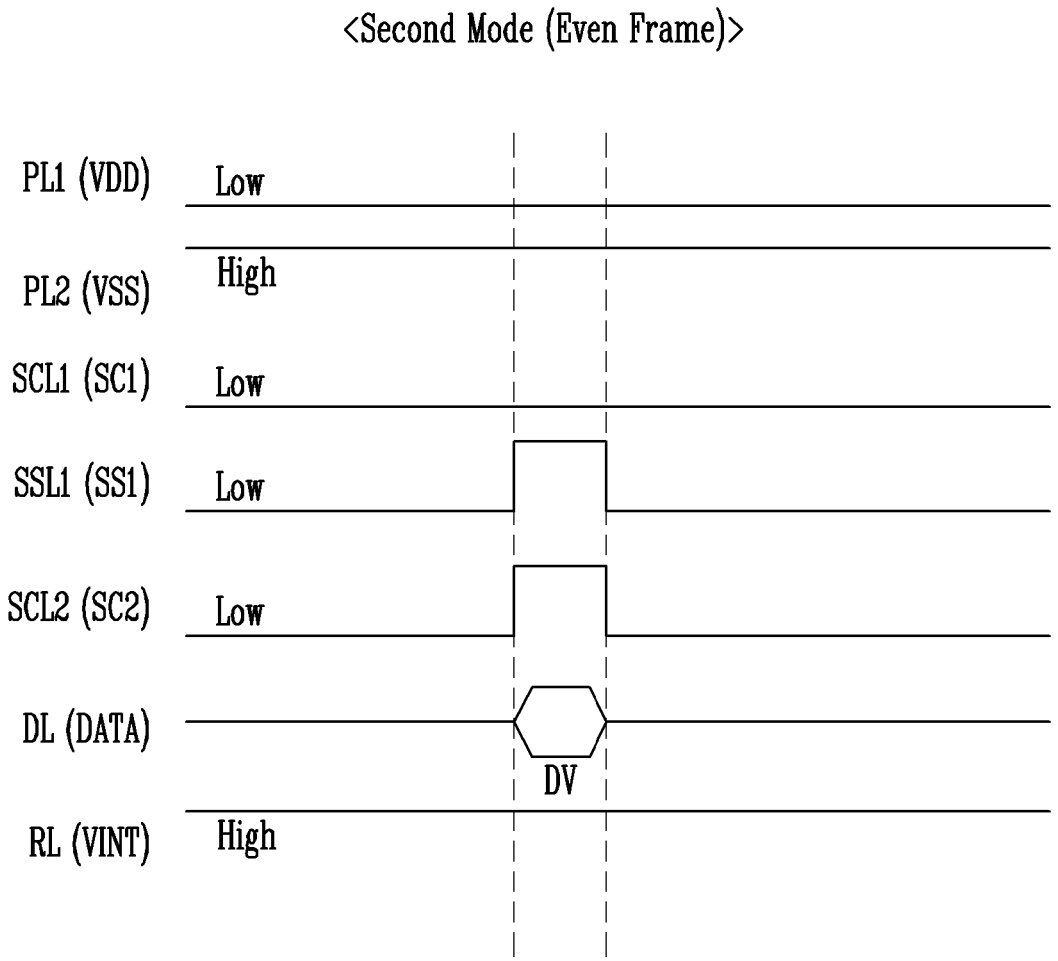
FIGS. 7A-7C are diagrams illustrating another example of the operations of the pixels of FIGS. 4A and 4B.
Figure 7B:
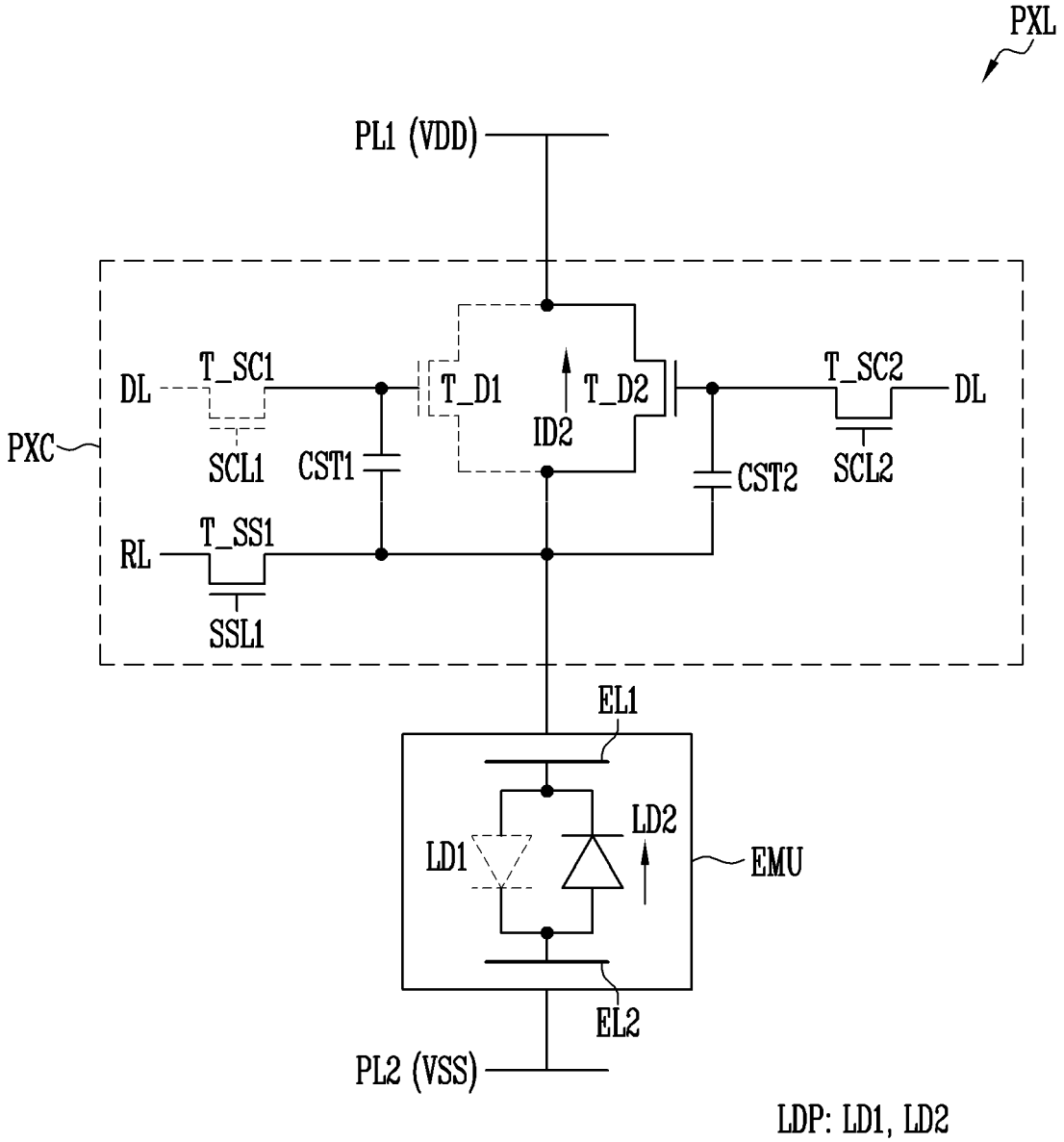
Figure 7C:
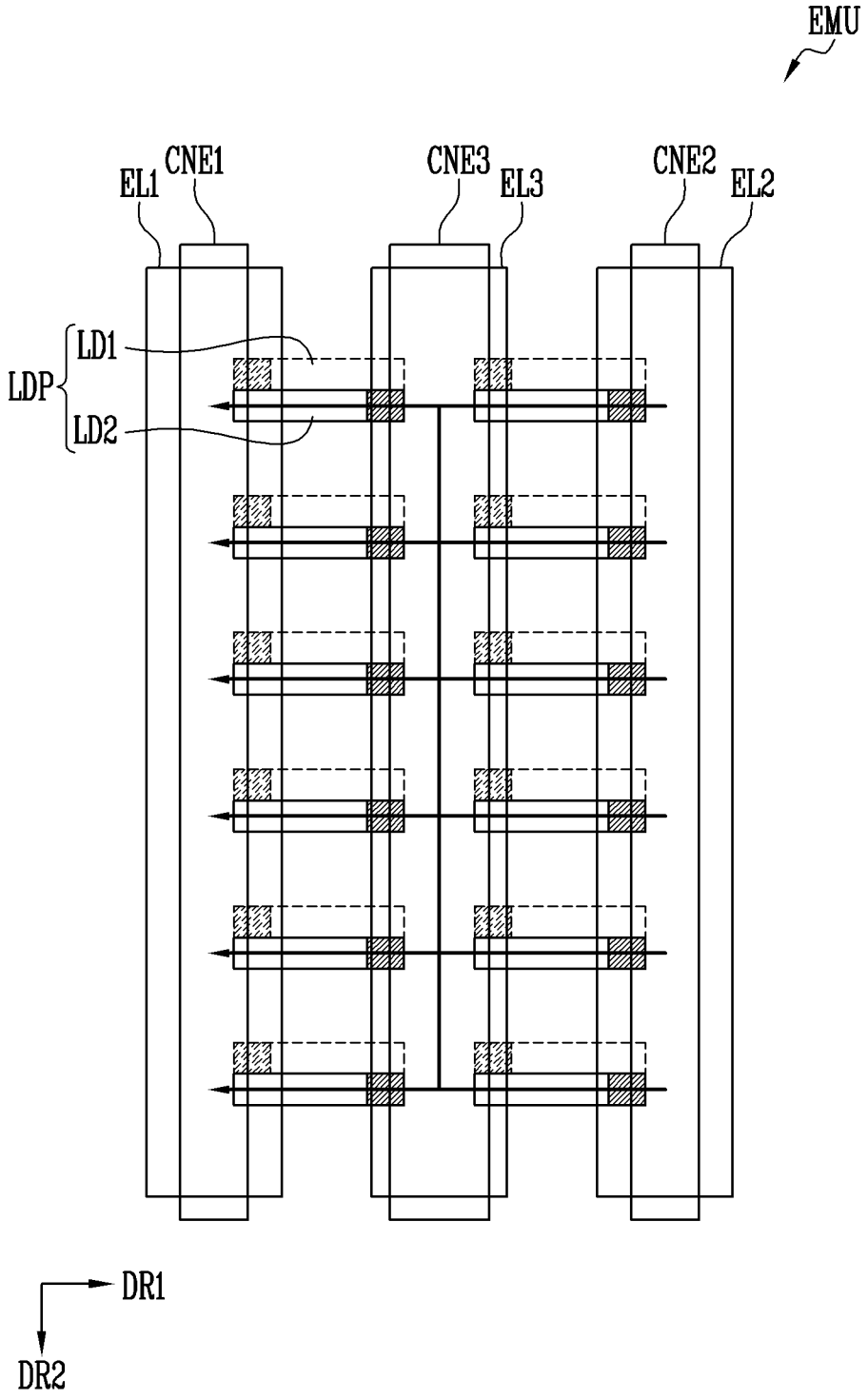

FIGS. 7A-7C are diagrams illustrating another example of the operations of the pixels of FIGS. 4A and 4B. FIGS. 7A-7C illustrate a timing diagram for the operations of the pixels PXL of FIGS. 4A and 4B in the second mode, a circuit diagram of the pixel PXL, and the operation of the emission unit EMU accordingly.

Referring to FIGS. 4A-5C and 7A-7C, it will be described that the pixel PXL is driven in the second mode in an even frame from among a plurality of frames (or frame sections). However, this is only an example, and the pixel PXL may be driven in the second mode during two or more consecutive frames.

In the second mode, the first driving voltage VDD having the low level (or low potential) may be applied to the first power line PL1, and the second driving voltage VSS having the high level (or high potential) may be applied to the second power line PL2. Compared with the first mode, the voltage levels applied to the first power line PL1 and the second power line PL2 are interchanged. When the pixel PXL or the pixel circuit PXC is alternately driven in the first mode and the second mode with a specific period (e.g., at least one frame), the voltage level of the first driving voltage VDD (or the first power supply voltage) applied to the first power line PL1 and the voltage level of the second driving power VSS (or the second power supply voltage) applied to the second power line PL2 may be interchanged with a specific period.

The second scan signal SC2 applied to the second scan line SCL2 may have the high level (or the turn-on voltage level, the gate-on voltage level, etc.). In this case, the second scan transistor T_SC2 may be turned on, and the data voltage DV applied to the data line DL may be applied to the gate electrode of the second driving transistor T_D2.

At the same time, the first sensing signal SS1 applied to the first sensing line SSL1 may have the high level. In this case, the first sensing transistor T_SS1 may be turned on, and the initialization voltage VINT applied to the readout line RL may be applied to the second terminal (or drain electrode) of the second driving transistor T_D2. The emission unit EMU may not emit light due to the initialization voltage VINT.

The second storage capacitor CST2 may store the voltage (or charge) corresponding to the difference between the data voltage DV and the initialization voltage VINT. In another embodiment, as illustrated in FIG. 7B, the second storage capacitor CST2 may store the voltage corresponding to the difference between the data voltage DV and the voltage level of the second driving voltage VSS applied to the second power line PL2.

When the second scan signal SC2 and the first sensing signal SS1 change from the high level to the low level, the second driving transistor T_D2 may supply a second driving current ID2 flowing in the second current flowing direction to the emission unit EMU in response to the voltage stored in the second storage capacitor CST2.

In this case, the second driving current ID2 may flow through the second light emitting element LD2 arranged in the second current flowing direction in the emission unit EMU, and the second light emitting element LD2 may emit light having a luminance corresponding to the second driving current ID2.

In the second mode, the first scan signal SC1 applied to the first scan line SCL1 may be maintained at the low level (or the turn-off voltage level, the gate-off voltage level, etc.). Therefore, the first scan transistor T_SC1 may maintain a turned-off state, and the data voltage DV may not be applied to the gate electrode of the first driving transistor T_D1. Further, because the second driving current ID2 does not flow through the first light emitting element LD1 arranged in the first current flowing direction in the emission unit EMU, the first light emitting element LD1 may not emit light.

As illustrated in FIG. 7C, because the second light emitting element LD2 in the emission unit EMU emits uniform light, cluster dark spots or stains may not occur. Further, compared with FIG. 6C, because the second light emitting element LD2 having the same ratio (or number) as the first light emitting element LD1 emits light, the change in the luminance of the emission unit EMU may not occur between the first mode and the second mode. Therefore, when the pixels PXL are alternately driven in the first mode and the second mode, the first light emitting element LD1 and the second light emitting element LD2 may be used evenly, thereby doubling the lifespan of the display device.

Figure 8:
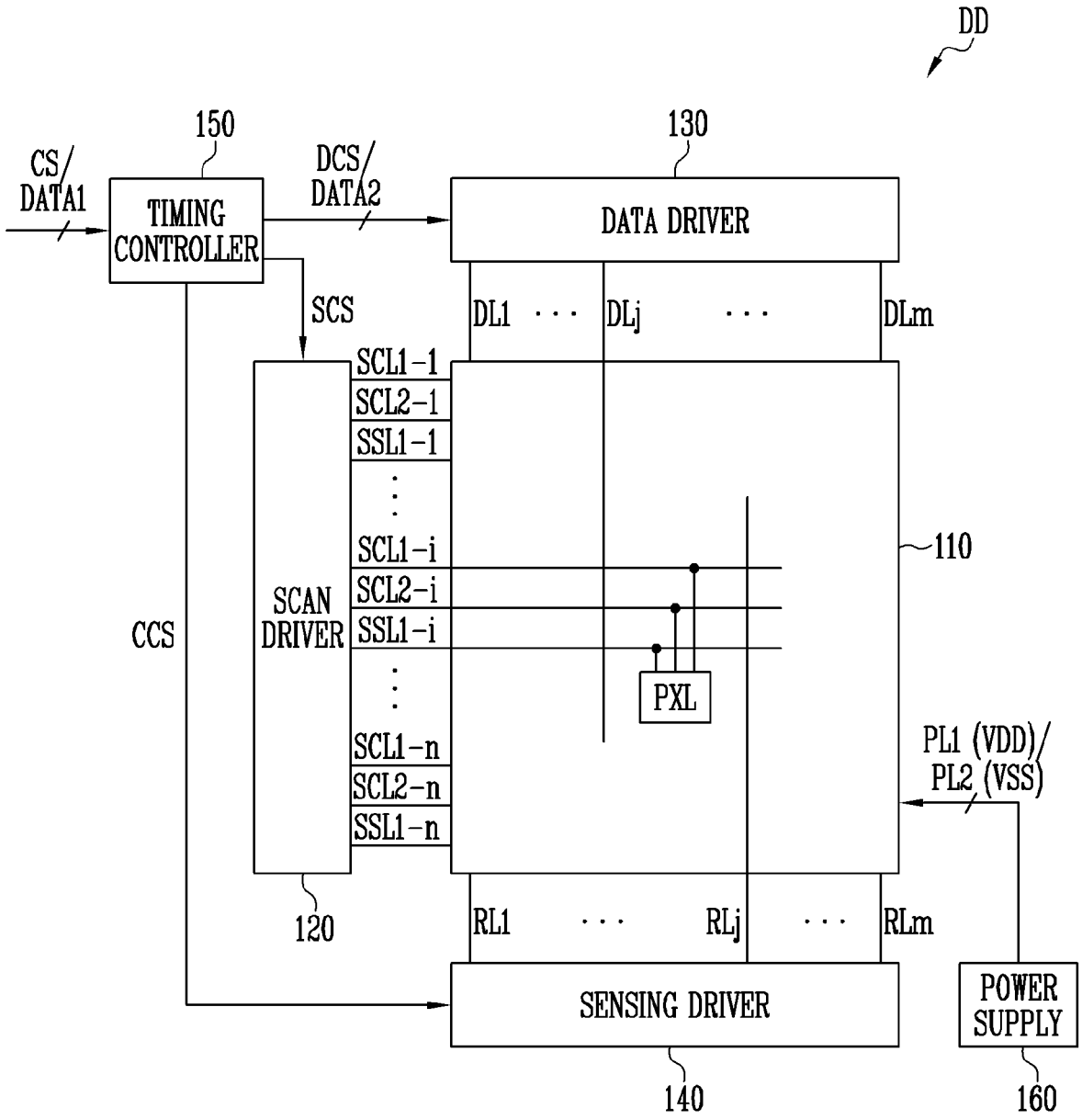
FIG. 8 is a block diagram illustrating a display device according to an embodiment.

FIG. 8 is a block diagram illustrating a display device according to an embodiment. According to an embodiment, the display device of FIG. 8 may include the pixel PXL of FIGS. 4A and 4B.

Referring to FIG. 8, the display device DD may include a display 110 (or a display panel), a scan driver 120 (or a gate driver), a data driver 130 (or a source driver), a sensing driver 140, a timing controller 150, and a power supply 160.

The display 110 may include first scan lines SCL1-1 to SCL1-*n* (where n is a positive integer), second scan lines SCL2-1 to SCL2-*n* (where n is a positive integer), data lines DL1 to DLm (where m is a positive integer), and a pixel PXL. Further, the display 110 may further include sensing lines SSL1-1 to SSL1-*n* and readout lines RL1 to RLm.

The pixel PXL may be provided in an area (e.g., a pixel area) partitioned by the first scan lines SCL1-1 to SCL1-*n*, the second scan lines SCL2-1 to SCL2-*n*, and the data lines DL1 to DLm.

The pixel PXL may be connected to the corresponding one of the first scan lines SCL1-1 to SCL1-*n*, the corresponding one of the second scan lines SCL2-1 to SCL2-*n*, and the corresponding one of the data lines DL1 to DLm. Further, the pixel PXL may be connected to the corresponding one of the sensing lines SSL1-1 to SSL1-*n* and the corresponding one of the readout lines RL1 to RLm.

As described above with reference to FIGS. 4A and 4B, the pixel PXL may include the first and second light emitting elements LD1 and LD2 and at least one transistor that provides or is configured to provide the driving current to the first and second light emitting elements LD1 and LD2 (or the light emitting element package LDP).

In the first mode, the pixel PXL may emit light having a luminance corresponding to a data voltage (e.g., a data signal) provided through a data line (e.g., a j-th data line DLj, where j is a positive integer less than or equal to m) in response to a first scan signal provided through a first scan line (e.g., a (1-i)-th scan line SCL1-*i*, where i is a positive integer less than or equal to n). Further, in the second mode, the pixel PXL may emit light having a luminance corresponding to a data voltage provided through a data line (e.g., a j-th data line DLj) in response to a second scan signal provided through a second scan line (e.g., a (2-i)-th scan line SCL2-*i*).

Because the detailed configuration and operation of the pixel PXL has been described above with reference to FIGS. 4A-7C, descriptions thereof will be omitted.

The scan driver 120 may generate the first scan signal or the second scan signal based on a scan control signal SCS, and may sequentially provide the first scan signal or the second scan signal to the first scan lines SCL1-1 to SCL1-*n* or the second scan lines SCL2-1 to SCL2-*n*. The scan control signal SCS may include a scan start signal (or scan start pulse), scan clock signals, and the like, and may be provided from the timing controller 150. For example, the scan driver 120 may include a shift register (or stage) for sequentially generating and outputting a pulsed first scan signal or second scan signal corresponding to a pulsed scan start signal (e.g., a gate-on voltage level pulse) using scan clock signals.

Similar to the first and second scan signals, the scan driver 120 may further generate a first sensing signal (or sensing control signal), and may sequentially apply the first sensing signal to the sensing lines SSL1-1 to SSL1-*n*.

The data driver 130 may generate data signals (or data voltages) based on a data control signal DCS and image data DATA2 provided from the timing controller 150, and may provide the data signals to the data lines DL1 to DLm. The data control signal DCS is a signal for controlling the operation of the data driver 130 and may include a load signal (or a data enable signal) indicating the output of an effective data voltage.

The sensing driver 140 may provide the initialization voltage to the readout lines RL1 to RLm based on the sensing control signal CCS. The sensing control signal CCS may be provided from the timing controller 150. According to an embodiment, the sensing driver 140 may sense the light emission characteristics of the pixel PXL through the readout lines RL1 to RLm.

The timing controller 150 may receive input image data DATA1 and the control signal CS from the outside (e.g., a graphic processor), may generate the scan control signal SCS and the data control signal DCS based on the control signal CS, and may convert the input image data DATA1 to generate image data DATA2. The control signal CS may include a vertical synchronization signal, a horizontal synchronization signal, a clock signal, and the like, which are generally known. For example, the timing controller 150 may convert the input image data DATA1 into the image data DATA2 having a format that is usable by the data driver 130.

Further, the timing controller 150 may generate the sensing control signal CCS based on the control signal CS. The sensing control signal CCS may be provided to the sensing driver 140.

The power supply 160 may provide the first driving voltage VDD (or the first power supply voltage) and the second driving voltage VSS (or the second power supply voltage) to the display 110. In an embodiment, the power supply 160 may provide the first driving voltage VDD to the first power line PL1 and may provide the second driving voltage VSS to the second power line PL2.

In an embodiment, the power supply 160 may generate the first driving voltage VDD of the high potential and the second driving voltage VSS of the low potential in the first mode, and may generate the first driving voltage VDD of the low potential and the second driving voltage VSS of the high potential in the second mode.

The power supply 160 may provide the driving voltage to at least one of the scan driver 120, the data driver 130, and the sensing driver 140.

In FIG. 8, the scan driver 120, the data driver 130, the sensing driver 140, and the timing controller 150 are illustrated as being configured independently of each other, but this is only an example and the present disclosure is not limited thereto. For example, at least one of the scan driver 120, the data driver 130, the sensing driver 140, and the timing controller 150 may be formed on the display 110, or may be implemented as an integrated circuit (IC) mounted on a flexible circuit board and connected to the display 110. For example, the scan driver 120 may be formed on the display 110. Further, at least two of the scan driver 120, the data driver 130, the sensing driver 140, and the timing controller 150 may be implemented as one IC. For example, the data driver 130 and the sensing driver 140 may be implemented as one IC.

Figure 9A:
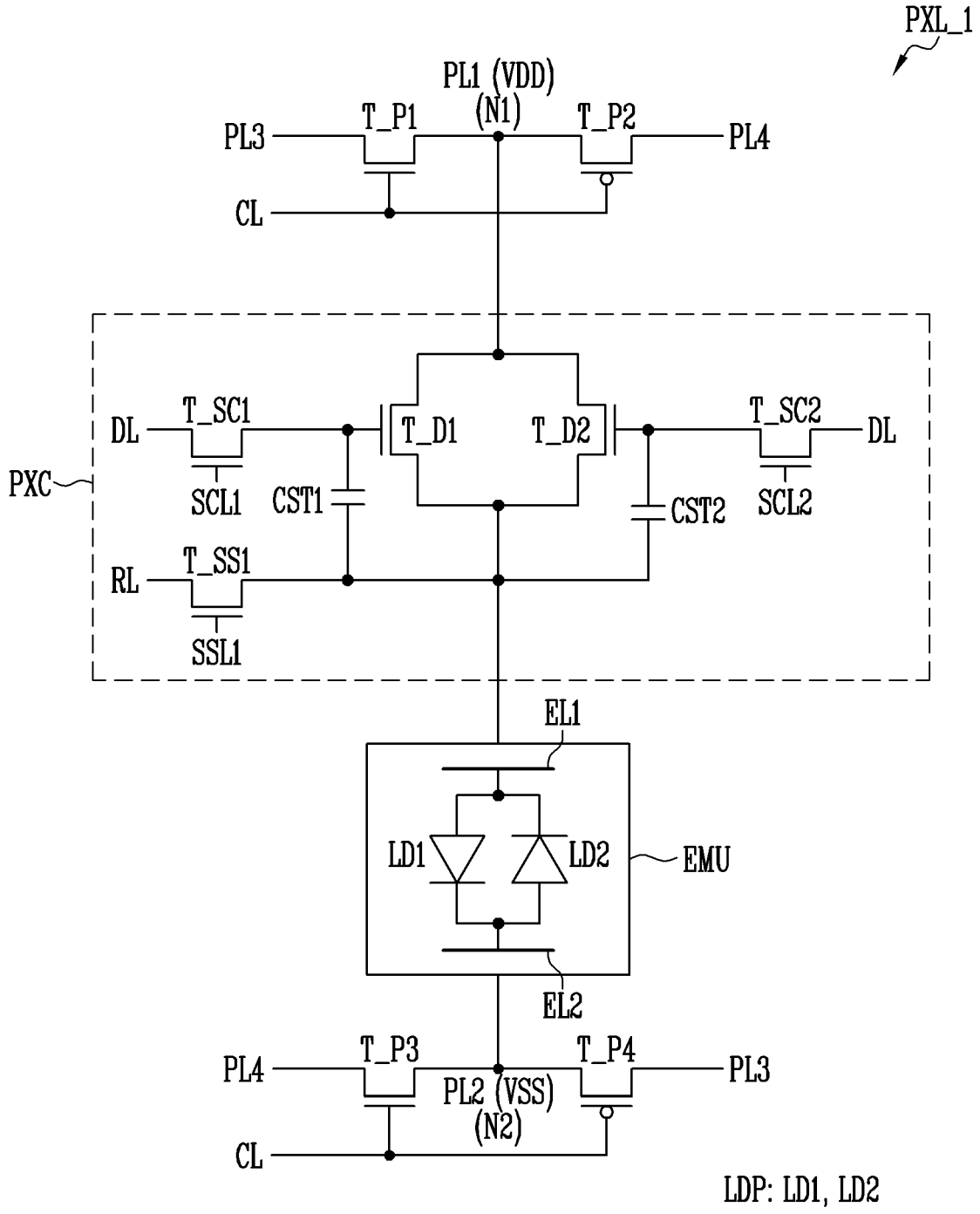
FIGS. 9A and 9B are circuit diagrams illustrating another embodiment of a pixel included in the display device of FIG. 3.
Figure 9B:
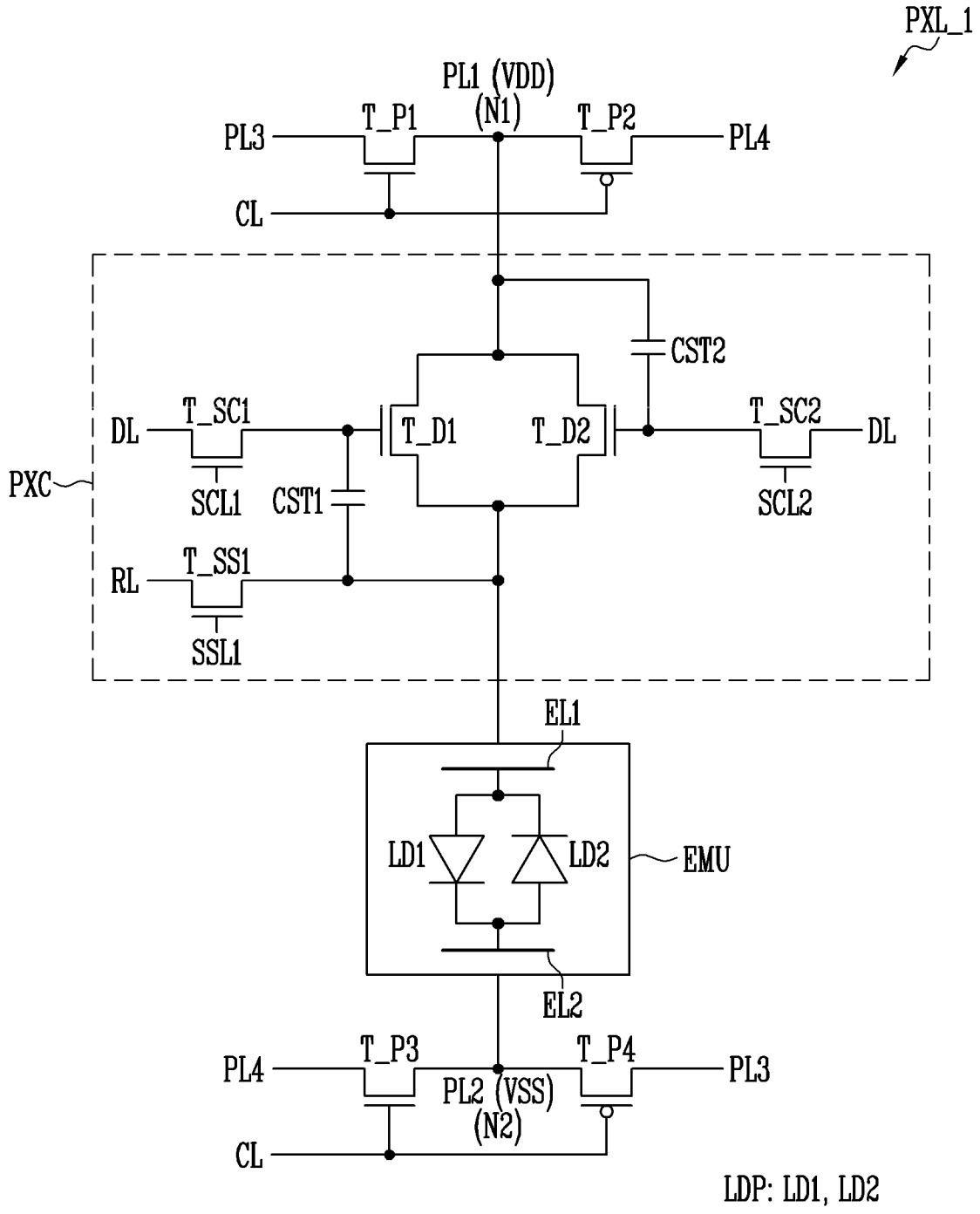

FIGS. 9A and 9B are circuit diagrams illustrating another embodiment of a pixel included in the display device of FIG. 3. FIGS. 9A and 9B show an electrical connection relationship between elements included in one pixel PXL illustrated in FIG. 3.

In FIGS. 9A and 9B, not only the elements included in each of the pixels illustrated in FIG. 3 but also the region in which the elements are provided are referred to as a pixel PXL.

Referring to FIGS. 1A-4B, 9A, and 9B, pixels PXL_1 differ from the pixels PXL illustrated in FIGS. 4A and 4B in that the pixels PXL_1 further include a first power transistor T_P1, a second power transistor T_P2, a third power transistor T_P3, and a fourth power transistor T_P4 (or first to fourth power control transistors, first to fourth switches, etc.). Because the pixels PXL_1 of FIGS. 9A and 9B is substantially identical or similar to the pixels PXL of FIGS. 4A and 4B, except for the first power transistor T_P1, the second power transistor T_P2, the third power transistor T_P3, and the fourth power transistor T_P4, redundant descriptions thereof will not be repeated.

A first terminal of the first power transistor T_P1 may be electrically connected to a third power line PL3, and a second terminal of the first power transistor T_P1 may be electrically connected to a first power line PL1 (or a first node N1). The first terminal and the second terminal of the first power transistor T_P1 may be different terminals. For example, when the first terminal is a source electrode, the second terminal may be a drain electrode. A gate electrode of the first power transistor T_P1 may be connected to a control line CL (or a switch control line). The first driving voltage VDD (or first power supply voltage) may be applied to the third power line PL3.

A first terminal of the second power transistor T_P2 may be electrically connected to the first power line PL1, and a second terminal of the second power transistor T_P2 may be electrically connected to a fourth power line PL4. A gate electrode of the second power transistor T_P2 may be connected to the control line CL. The second driving voltage VSS (or second power supply voltage) may be applied to the fourth power line PL4.

In some embodiments, the first power transistor T_P1 and the second power transistor T_P2 may be different types of transistors. One of the first power transistor T_P1 and the second power transistor T_P2 may be an N-type transistor, and the other one of the first power transistor T_P1 and the second power transistor T_P2 may be a P-type transistor. As illustrated in FIGS. 9A and 9B, the first power transistor T_P1 may be an N-type transistor, and the second power transistor T_P2 may be a P-type transistor. In this case, the first power transistor T_P1 or the second power transistor T_P2 may be turned on in response to a switching control signal provided through the control line CL, and the first driving voltage VDD of the third power line PL3 or the second driving voltage VSS of the fourth power line PL4 may be applied to the first power line PL1.

In order to drive the pixels PXL of FIGS. 4A and 4B, the power supply 160 (see FIG. 8) has to interchange the voltage level of the first driving voltage VDD and the voltage level of the second driving voltage VSS. According to some embodiments, in the pixels PXL_1 of FIGS. 9A and 9B, the voltage level of the first driving voltage VDD and the voltage level of the second driving voltage VSS may be fixed to high potential and low potential, respectively, and the pixel PXL_1 may be driven only by controlling the first power transistor T_P1 and the second power transistor T_P2 using one switching control signal.

Further, when the pixel PXL_1 includes the first power transistor T_P1 and the second power transistor T_P2, the first and second driving voltages VDD and VSS applied to the pixel PXL_1 may be individually controlled (e.g., for each pixel row).

A first terminal of the third power transistor T_P3 may be electrically connected to a fourth power line PL4, and a second terminal of the third power transistor T_P3 may be electrically connected to a second power line PL2 (or a second node N2). A gate electrode of the third power transistor T_P3 may be connected to the control line CL.

A first terminal of the fourth power transistor T_P4 may be electrically connected to the second power line PL2, and a second terminal of the fourth power transistor T_P4 may be electrically connected to a third power line PL3. A gate electrode of the fourth power transistor T_P4 may be connected to the control line CL.

In some embodiments, the third power transistor T_P3 and the fourth power transistor T_P4 may be different types of transistors. The third power transistor T_P3 may be a transistor of the same type as the first power transistor T_P1, and the fourth power transistor T_P4 may be a transistor of the same type as the second power transistor T_P2. As illustrated in FIGS. 9A and 9B, the third power transistor T_P3 may be an N-type transistor, and the fourth power transistor T_P4 may be a P-type transistor. In this case, the third power transistor T_P3 or the fourth power transistor T_P4 may be turned on in response to a switching control signal provided through the control line CL, and the second driving voltage VSS of the fourth power line PL4 or the first driving voltage VDD of the third power line PL3 may be applied to the second power line PL2.

As described above, the pixel PXL_1 may further include the first power transistor T_P1, the second power transistor T_P2, the third power transistor T_P3, and the fourth power transistor T_P4 in order to interchange and apply the first driving voltage VDD and the second driving voltage VSS to the first power line PL1 and the second power line PL2. Therefore, the driving voltage of the pixel PXL_1 may be easily controlled by using the signal of the relatively low voltage level (e.g., easily controlled only by using the signal of the relatively low voltage level) applied to the first power transistor T_P1, the second power transistor T_P2, the third power transistor T_P3, and the fourth power transistor T_P4.

The pixels PXL_1 of FIGS. 9A and 9B may be applied to the display device DD of FIG. 8.

Figure 10A:
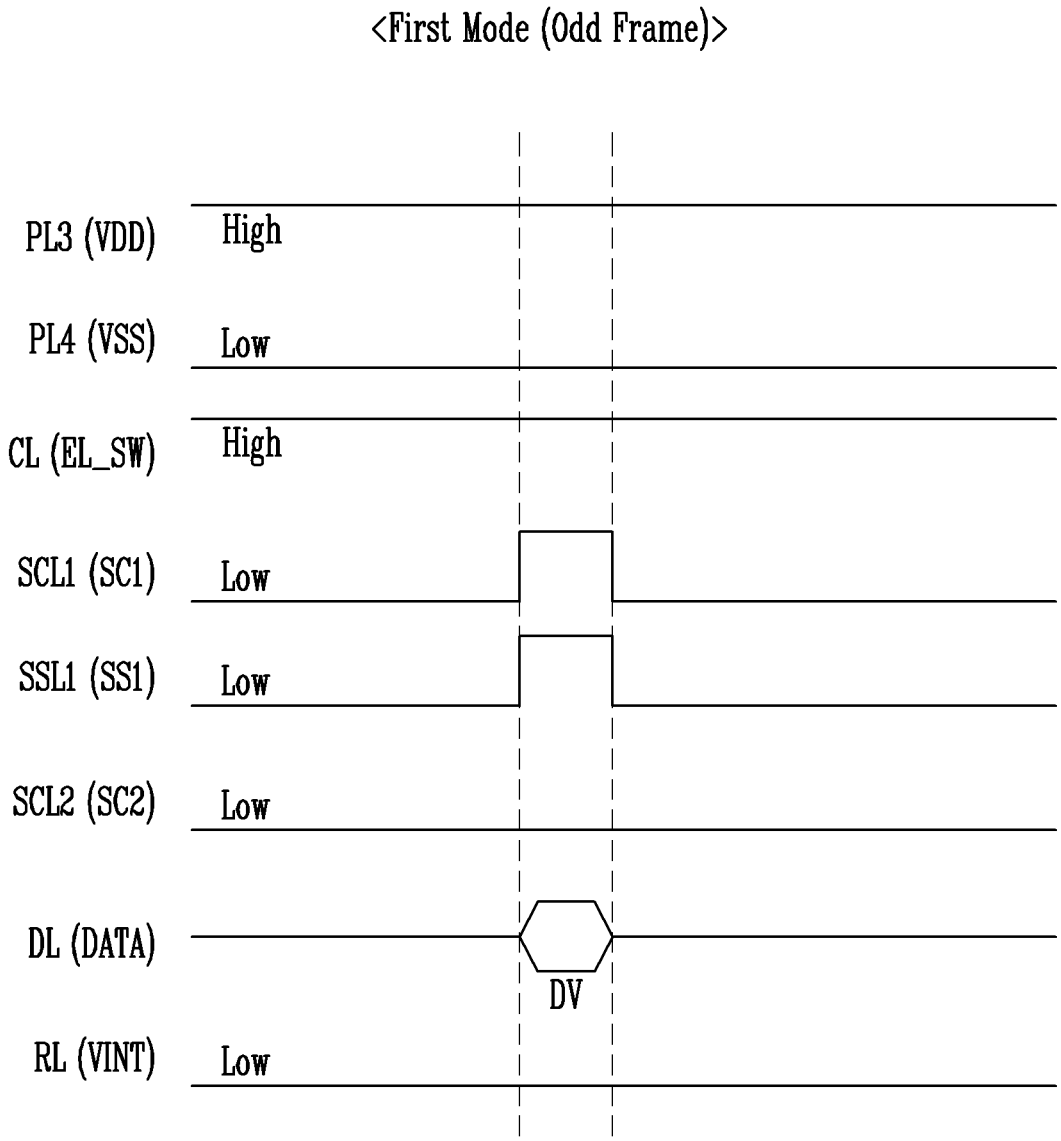
FIGS. 10A and 10B are diagrams illustrating an example of the operation of the pixel of FIGS. 9A and 9B.
Figure 10B:
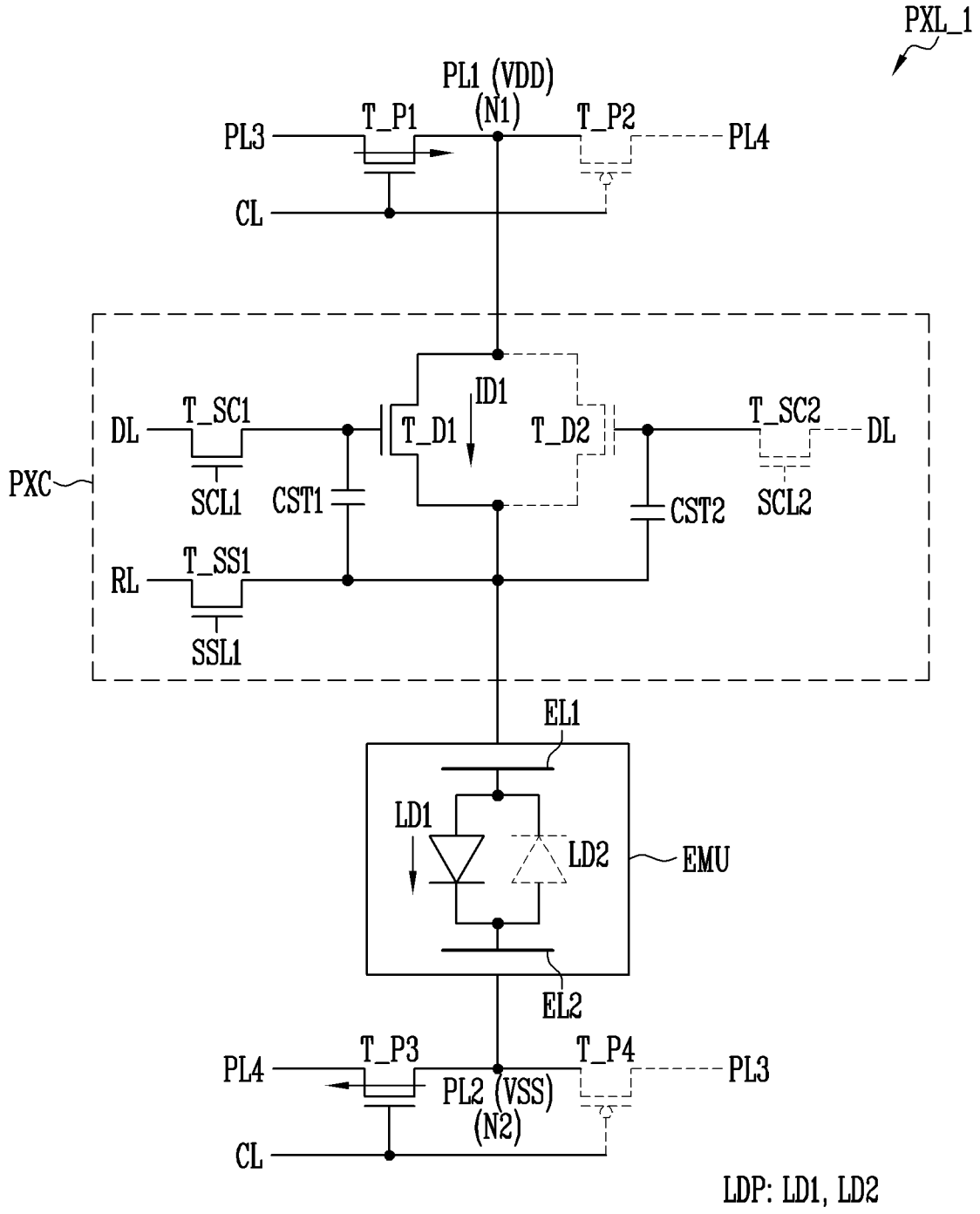

FIGS. 10A and 10B are diagrams illustrating an example of the operations of the pixels of FIGS. 9A and 9B. FIGS. 10A and 10B illustrate a timing diagram for the operations of the pixels PXL_1 of FIGS. 9A and 9B in a first mode, and a circuit diagram of the pixels PXL_1 accordingly.

Referring to FIGS. 6A, 6B, and 9A-10B, because the signals applied to the pixel PXL_1 are substantially the same as the signals described above with reference to FIGS. 6A and 6B, except for a switching control signal EL_SW applied to a control line CL, redundant descriptions thereof will not be repeated.

In the first mode, a switching control signal EL_SW having a high level may be applied to the control line CL. In this case, a first power transistor T_P1 may be turned on, and a first driving voltage VDD of a high potential may be applied to a first power line PL1. Further, a third power transistor T_P3 may be turned on, and a second driving voltage VSS of a low potential may be applied to a second power line PL2. Accordingly, a first driving current ID1 may flow in a first current flowing direction between the first power line PL1 and the second power line PL2 according to the operation of the first driving transistor T_D1 described above with reference to FIGS. 4A and 4B, and a first light emitting element LD1 may emit light.

In the first mode, a second power transistor T_P2 and a fourth power transistor T_P4 may maintain a turned-off state in response to the switching control signal EL_SW having the high level.

Figure 11A:
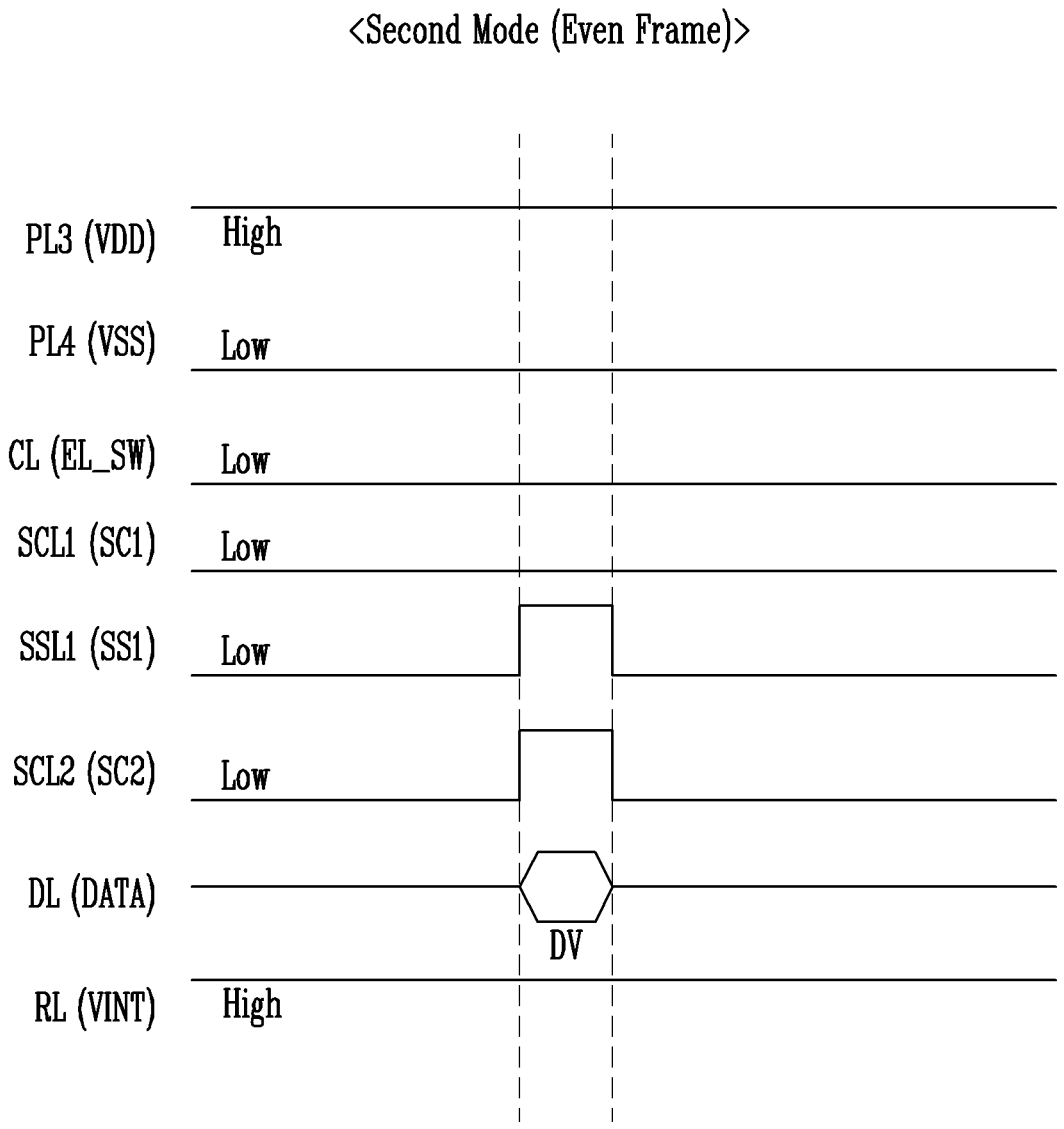
FIGS. 11A and 11B are diagrams illustrating another example of the operation of the pixel of FIGS. 9A and 9B.
Figure 11B:
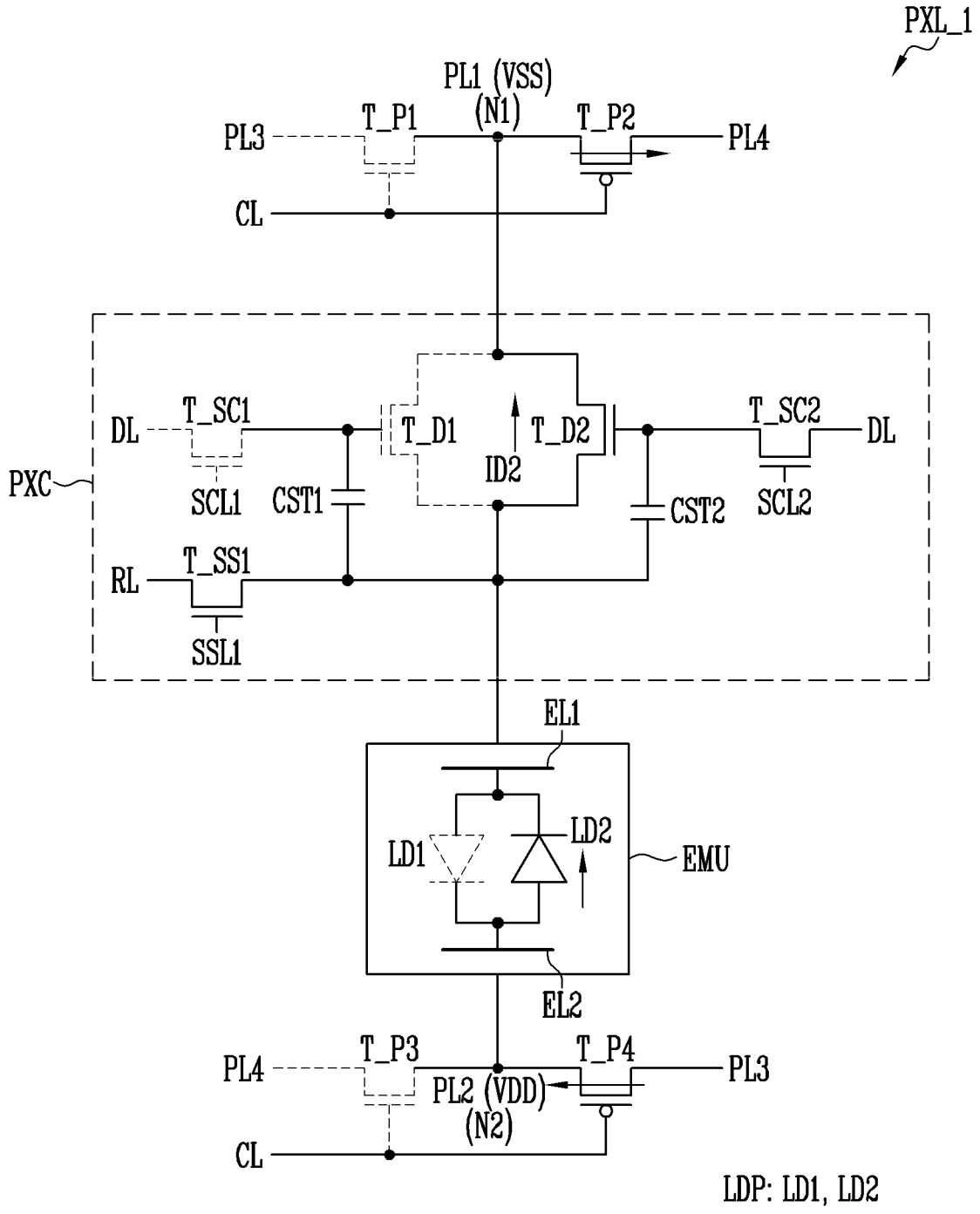

FIGS. 11A and 11B are diagrams illustrating another example of the operations of the pixels of FIGS. 9A and 9B.

FIGS. 11A and 11B illustrate a timing diagram for the operations of the pixels PXL_1 of FIGS. 9A and 9B in a second mode, and a circuit diagram of the pixels PXL_1 accordingly.

In the second mode, a switching control signal EL_SW having a low level may be applied to the control line CL. In this case, a second power transistor T_P2 may be turned on, and a second driving voltage VSS of a low potential may be applied to a first power line PL1. Further, a fourth power transistor T_P4 may be turned on, and a first driving voltage VDD of a high potential may be applied to a second power line PL2. Accordingly, a second driving current ID2 may flow in a second current flowing direction between the second power line PL2 and the first power line PL1 according to the operation of the second driving transistor T_D2 described above with reference to FIGS. 4A and 4B, and a second light emitting element LD2 may emit light.

In the second mode, a first power transistor T_P1 and a third power transistor T_P3 may maintain a turned-off state in response to the switching control signal EL_SW having the low level.

The pixel and the display device including the same according to embodiments of the present disclosure include an emission unit, and the emission unit may include at least a pair of a first light emitting element and a second light emitting element arranged in different polarity directions between the first electrode and the second electrode. Because the first light emitting element and the second light emitting element are arranged in pair, the proportion of the first light emitting element and the proportion of the second light emitting element appear uniformly throughout the pixel and the display device, and the luminance deviation of the pixel and the display device may be improved.

Further, the pixel and the display device may provide a first driving current to the emission unit in a first current flowing direction in a first mode, and may provide a second driving current to the emission unit in a second current flowing direction in a second mode. When the first mode and the second mode alternate in a specific period, the first light emitting element and the second light emitting element in the emission unit alternately emit light. The lifespan of the emission unit may be improved, compared with the case in which only the first light emitting element or the second light emitting element emits light in response to one current direction.

Effects and aspects according to embodiments of the present disclosure are not limited by the above description, and more various effects and aspects are incorporated in the present disclosure.

While the present disclosure has been described with reference to described embodiments, it will be understood by those with ordinary skill in the relevant technical field that the present disclosure can be variously modified and changed without departing from the spirit and scope of the present disclosure set forth in the appended claims and equivalents thereof.

Therefore, the technical scope of the present disclosure should not be limited to the contents described in the detailed description, but should be determined by the appended claims and equivalents thereof.

What is claimed is:

1. A pixel comprising:

an emission unit connected between a first power line and a second power line; and a pixel circuit to provide a first driving current to the emission unit in a first current flowing direction in a first mode, and to provide a second driving current to the emission unit in a second current flowing direction different from the first current flowing direction in a second mode, wherein the emission unit comprises:

a first electrode and a second electrode spaced from each other;

a first light emitting element connected between the first electrode and the second electrode in the first current flowing direction;

a second light emitting element connected between the first electrode and the second electrode in the second current flowing direction, and a plurality of light emitting element packages connected between the first electrode and the second electrode, wherein each of the plurality of light emitting element packages comprises a first lead electrode, a second lead electrode, and a pair of light emitting elements arranged between the first lead electrode and the second lead electrode in different current flowing directions, and wherein the pair of light emitting elements comprises the first light emitting element and the second light emitting element.

2. The pixel of claim 1, wherein the pixel circuit comprises:

a first driving transistor connected between the first power line and the first electrode;

a first scan transistor connected between a data line and a gate electrode of the first driving transistor, the first scan transistor having a gate electrode connected to a first scan line; and a first storage capacitor connected between the gate electrode of the first driving transistor and the first electrode, wherein the second electrode is connected to the second power line.

3. The pixel of claim 2, wherein the pixel circuit further comprises a first sensing transistor connected between a readout line and the first electrode, the first sensing transistor having a gate electrode connected to a first sensing line.

4. The pixel of claim 3, wherein the pixel circuit further comprises:

a second driving transistor connected between the first power line and the first electrode; and a second scan transistor connected between the data line and a gate electrode of the second driving transistor, the second scan transistor having a gate electrode connected to a second scan line.

5. The pixel of claim 4, wherein the pixel circuit further comprises a second storage capacitor connected between the gate electrode of the second driving transistor and one electrode of the second driving transistor.

6. The pixel of claim 5, wherein the second storage capacitor is connected between the gate electrode of the second driving transistor and the first electrode.

7. The pixel of claim 5, wherein the second storage capacitor is connected between the gate electrode of the second driving transistor and the first power line.

8. The pixel of claim 5, wherein, in the first mode, the first scan transistor and the first sensing transistor are turned on and the second scan transistor is turned off, and wherein, in the second mode, the second scan transistor and the first sensing transistor are turned on and the first scan transistor is turned off.

9. The pixel of claim 8, wherein the pixel circuit is alternately driven in the first mode and the second mode with a first period, and wherein the first period is greater than or equal to one frame.

10. The pixel of claim 9, wherein a voltage level of a first power supply voltage applied to the first power line and a voltage level of a second power supply voltage applied to the second power line are interchanged with the first period.

11. The pixel of claim 1, further comprising:

a first power control transistor connected between the first power line and a third power line, the first power control transistor having a gate electrode connected to a control line; and a second power control transistor connected between the first power line and a fourth power line, the second power control transistor having a gate electrode connected to the control line, wherein one of the first power control transistor and the second power control transistor is an N-type transistor, and other one of the first power control transistor and the second power control transistor is a P-type transistor.

12. The pixel of claim 11, further comprising:

a third power control transistor connected between the second power line and the fourth power line, the third power control transistor having a gate electrode connected to the control line; and a fourth power control transistor connected between the second power line and the third power line, the fourth power control transistor having a gate electrode connected to the control line, wherein the third power control transistor is a transistor of a same type as the first power control transistor, and the fourth power control transistor is a transistor of a same type as the second power control transistor.

13. The pixel of claim 1, wherein a first end portion of the first light emitting element and a second end portion of the second light emitting element are electrically connected to the first electrode, wherein a second end portion of the first light emitting element and a first end portion of the second light emitting element are electrically connected to the second electrode, and wherein the first end portion of the first light emitting element and the first end portion of the second light emitting element correspond to a same type of a semiconductor layer.

14. The pixel of claim 1, wherein a total number of the first light emitting element in the emission unit is substantially equal to a total number of the second light emitting element in the emission unit.

15. The pixel of claim 1, wherein some of the plurality of light emitting element packages are mutually connected in series between the first electrode and the second electrode.

16. A display device comprising:

pixels;

a scan driver to supply scan signals to the pixels through scan lines and to supply sensing signals to the pixels through sensing lines; and a data driver to supply data signals to the pixels through data lines and to supply an initialization signal to the pixels through readout lines, wherein each of the pixels comprises:

an emission unit connected between a first power line and a second power line; and a pixel circuit to provide a first driving current to the emission unit in a first current flowing direction in response to a first scan signal from among the scan signals and a first sensing signal from among the sensing signals in a first mode, and to provide a second driving current to the emission unit in a second current flowing direction different from the first current flowing direction in response to a second scan signal from among the scan signals and the first sensing signal in a second mode, wherein the emission unit comprises:

a first electrode and a second electrode spaced from each other;

a first light emitting element connected between the first electrode and the second electrode in the first current flowing direction;

a second light emitting element connected between the first electrode and the second electrode in the second current flowing direction, and a plurality of light emitting element packages connected between the first electrode and the second electrode, wherein each of the plurality of light emitting element packages comprises a first lead electrode, a second lead electrode, and a pair of light emitting elements arranged between the first lead electrode and the second lead electrode in different current flowing directions, and wherein the pair of light emitting elements comprises the first light emitting element and the second light emitting element.

17. The display device of claim 16, wherein a total number of the first light emitting element in the emission unit is substantially equal to a total number of the second light emitting element in the emission unit.

18. The display device of claim 16, further comprising a power supply to supply, to the pixels, a first power supply voltage through the first power line and a second power supply voltage through the second power line, wherein the power supply interchanges a voltage level of the first power supply voltage and a voltage level of the second power supply voltage with a first period.

19. The display device of claim 18, wherein the power supply is further configured to supply the first power supply voltage to a third power line and the second power supply voltage to a fourth power line, wherein each of the pixels further comprises:

a first power control transistor connected between the first power line and the third power line, the first power control transistor having a gate electrode connected to a control line; and a second power control transistor connected between the first power line and the fourth power line, the second power control transistor having a gate electrode connected to the control line, wherein one of the first power control transistor and the second power control transistor is an N-type transistor, and wherein other one of the first power control transistor and the second power control transistor is a P-type transistor.

* * * * *